US011649084B2

(12) United States Patent
Fenn

(10) Patent No.: US 11,649,084 B2
(45) **Date of Patent: *May 16, 2023**

(54) PACKAGING APPARATUS AND METHOD FOR OPERATING SAME

(71) Applicant: Signode Industrial Group LLC, Glenview, IL (US)

(72) Inventor: Carsten Fenn, Sonderborg (DK)

(73) Assignee: Signode Industrial Group LLC, Tampa, FL (US)

( * ) Notice: Subject to any disclaimer, the term of this patent is extended or adjusted under 35 U.S.C. 154(b) by 39 days.

This patent is subject to a terminal disclaimer.

(21) Appl. No.: 17/407,868

(22) Filed: Aug. 20, 2021

(65) Prior Publication Data

US 2021/0380301 A1 Dec. 9, 2021

Related U.S. Application Data

(63) Continuation of application No. 16/391,496, filed on Apr. 23, 2019, now Pat. No. 11,097,865, which is a (Continued)

(30) Foreign Application Priority Data

Feb. 2, 2015 (DE) ..... 10 2015 101 489.0

(51) Int. Cl.
*B65B 65/02* (2006.01)
*B65B 59/04* (2006.01)
(Continued)

(52) U.S. Cl.
CPC ..... *B65B 65/02* (2013.01); *B65B 9/135* (2013.01); *B65B 11/02* (2013.01); *B65B 59/04* (2013.01)

(58) Field of Classification Search
CPC .. B65B 9/10; B65B 9/13; B65B 9/135; B65B 9/14; B65B 11/54; B65B 59/00; B65B 59/04; B66F 9/07; B66F 9/072
(Continued)

(56) References Cited

U.S. PATENT DOCUMENTS 2,711,803 A 6/1955 Hurst
2,745,688 A 5/1956 Farrington et al.
(Continued)

FOREIGN PATENT DOCUMENTS

CN 101830292 A 9/2010
DE 2256753 A1 5/1974
(Continued)

OTHER PUBLICATIONS

"First Review Opinion and Search Report" with English Translation, from corresponding Chinese Patent Application No. 201610071439.2, dated Nov. 26, 2018.
(Continued)

*Primary Examiner* — Valentin Neacsu
(74) *Attorney, Agent, or Firm* — Neal, Gerber & Eisenberg LLP

(57) ABSTRACT

Various embodiments of the present disclosure are directed to a packaging apparatus and method for packaging an article with a tubular film to be pulled over the article. The packaging apparatus has a machine frame on which a film supply apparatus and a film covering apparatus are mounted. The packaging apparatus includes a releasable drive coupling usable to operatively couple a drive with either the film covering apparatus or the film supply apparatus (or a subcomponent of the film supply apparatus). Once coupled, the drive can move the film covering apparatus or the film supply apparatus relative to the frame.

12 Claims, 17 Drawing Sheets

Related U.S. Application Data continuation of application No. 15/007,634, filed on Jan. 27, 2016, now Pat. No. 10,273,031.

(51) Int. Cl.
*B65B 9/13* (2006.01)
*B65B 11/02* (2006.01)

(58) Field of Classification Search
USPC ..... 53/461, 459, 167, 567; 254/4 R, 134, 254/128; 414/788, 799, 914, 927
See application file for complete search history.

(56) References Cited

U.S. PATENT DOCUMENTS 2,758,898 A 8/1956 Karl
2,792,599 A 5/1957 Karl et al.
2,797,634 A 7/1957 Rueckert
2,942,797 A 6/1960 Lorenz et al.
3,016,869 A 1/1962 Anderson et al.
3,190,457 A 6/1965 Elis
3,278,059 A 10/1966 Ridgeway et al.
3,436,046 A 4/1969 Valeska
3,507,137 A 4/1970 Taleff et al.
3,626,654 A 12/1971 Hoffler et al.
3,679,244 A * 7/1972 Reddy ..... F16B 21/125 403/321
3,852,937 A * 12/1974 Bitsura ..... B65B 9/135 53/389.5
3,902,303 A * 9/1975 King ..... B65B 9/135 53/261
3,918,311 A * 11/1975 Maier ..... B28C 5/4213 74/371
3,944,045 A * 3/1976 Higgins ..... B65B 9/135 198/340
4,050,219 A * 9/1977 Higgins ..... B65B 9/135 53/567
4,063,401 A * 12/1977 Higgins ..... B65B 9/135 53/567
4,067,174 A 1/1978 Goldstein
4,204,377 A 5/1980 Lancaster
4,235,062 A * 11/1980 Lancaster, III ..... B65B 11/045 53/399
4,317,322 A 3/1982 Lancaster
4,473,990 A * 10/1984 Thimon ..... B65B 9/135 53/442
4,587,796 A 5/1986 Haloila
4,588,142 A 5/1986 Malzacher
4,619,193 A 10/1986 Crew
4,631,898 A 12/1986 Brambilla
4,754,594 A 7/1988 Lancaster
4,756,143 A 7/1988 Lancaster
4,905,448 A 3/1990 Plitt
4,905,451 A * 3/1990 Jaconelli ..... B65B 61/00 53/410
4,914,891 A 4/1990 Suolahti
4,939,989 A 7/1990 Zacharias
5,107,657 A 4/1992 Diehl et al.
5,140,795 A 8/1992 Steding
5,154,382 A 10/1992 Hoshino
5,195,297 A * 3/1993 Lancaster ..... B65B 11/045 53/399
5,216,871 A 6/1993 Hannen
5,463,843 A 11/1995 Sharp
5,471,818 A * 12/1995 Hannen ..... B65B 53/066 53/442
5,619,838 A 4/1997 Kasel
5,623,808 A 4/1997 Franklin et al.
6,032,439 A * 3/2000 Birkenfeld ..... B65B 9/135 53/567
6,237,307 B1 5/2001 Zentmyer et al.
6,298,636 B1 * 10/2001 Lachenmeier ..... B65B 9/135 53/442
6,470,654 B1 * 10/2002 Lachenmeier ..... B65B 9/135 53/461
6,516,591 B1 2/2003 Lancaster et al.
6,539,690 B2 4/2003 Alvarez
6,619,872 B2 9/2003 Crorey et al.
6,622,620 B1 9/2003 Byington
6,725,625 B1 4/2004 Honma et al.
6,865,865 B2 3/2005 Hannen et al.
6,945,163 B2 9/2005 Squyres
7,036,289 B2 5/2006 Suolahti
7,040,071 B2 5/2006 Heikaus
7,040,076 B2 5/2006 Lachenmeier et al.
7,234,289 B2 6/2007 Hannen et al.
7,325,487 B2 2/2008 Squyres
7,367,740 B2 5/2008 Lazic et al.
7,533,515 B1 5/2009 Koskela
7,707,801 B2 5/2010 Lancaster
7,707,802 B2 5/2010 Forrest
7,908,831 B1 3/2011 Dugan
7,913,476 B2 * 3/2011 Lachenmeier ..... B65B 9/135 53/567
7,937,910 B2 * 5/2011 Jaconelli ..... B65B 9/14 53/567
7,966,790 B2 * 6/2011 Michels ..... B65B 9/135 53/556
7,975,456 B2 * 7/2011 Lachenmeier ..... B65B 9/135 53/567
8,141,327 B2 3/2012 Lancaster
8,147,654 B2 * 4/2012 Sawada ..... D21F 7/083 162/900
8,347,784 B2 1/2013 Herrmann
8,453,420 B2 6/2013 Schmidt et al.
D693,982 S 11/2013 Lachenmeier et al.
8,875,480 B2 11/2014 Czok et al.
8,938,939 B2 1/2015 Roche
D749,815 S 2/2016 Lachenmeier et al.
9,440,756 B2 * 9/2016 Michels ..... B65B 9/135
9,776,746 B2 * 10/2017 Tellen ..... B65B 9/14
10,093,439 B2 10/2018 Lachenmeier et al.
10,273,031 B2 * 4/2019 Fenn ..... B65B 65/02
11,097,865 B2 * 8/2021 Fenn ..... B65B 9/135
2001/0046409 A1 11/2001 Fischer
2002/0033005 A1 * 3/2002 Lachenmeier ..... B65B 9/135 53/567
2003/0156891 A1 8/2003 Hung et al.
2004/0107677 A1 * 6/2004 Hannen ..... B65B 9/135 53/459
2006/0005511 A1 1/2006 Suolahti et al.
2006/0040085 A1 2/2006 Downs et al.
2006/0285915 A1 12/2006 Dellach et al.
2007/0140817 A1 * 6/2007 Hansl ..... B66F 9/07 414/277
2007/0157557 A1 7/2007 Lancaster
2007/0163207 A1 7/2007 Chiu
2009/0217624 A1 * 9/2009 Forrest ..... B65B 11/006 53/399
2009/0229226 A1 9/2009 Beeland et al.
2009/0272080 A1 * 11/2009 Lachenmeier ..... B65B 9/135 53/461
2009/0293425 A1 12/2009 Carter et al.
2010/0018165 A1 1/2010 Kudia
2010/0071317 A1 * 3/2010 Michels ..... B65B 9/135 53/567
2010/0163443 A1 * 7/2010 Storig ..... B65B 57/04 53/461
2010/0258241 A1 * 10/2010 Perecman ..... B65H 37/002 156/230
2011/0146210 A1 * 6/2011 Michels ..... B65B 9/135 53/461
2011/0258970 A1 * 10/2011 Michels ..... B65B 59/02 53/461
2011/0258973 A1 * 10/2011 Czok ..... B65B 9/135 53/247
2014/0013714 A1 1/2014 Lachenmeier et al.
2014/0053502 A1 2/2014 Pecchenini et al.
2014/0137516 A1 5/2014 Lachenmeier et al.
2014/0230380 A1 * 8/2014 Geerts ..... B65B 9/135 53/556

(56) References Cited

U.S. PATENT DOCUMENTS

| | | | | |
|---|---|---|---|---|
| 2014/0250831 | A1 | 9/2014 | Suolahti et al. | |
| 2015/0113920 | A1 | 4/2015 | Koskela et al. | |
| 2015/0232214 | A1 | 8/2015 | Suolahti et al. | |
| 2015/0251792 | A1 | 9/2015 | Koskela et al. | |
| 2015/0321781 | A1 | 11/2015 | Kristensen et al. | |
| 2016/0221703 | A1* | 8/2016 | Fenn | B65B 11/02 |
| 2017/0157880 | A1 | 6/2017 | Eckermann et al. | |
| 2019/0248530 | A1* | 8/2019 | Fenn | B65B 9/135 |
| 2021/0380301 | A1* | 12/2021 | Fenn | B65B 11/02 |

FOREIGN PATENT DOCUMENTS

| | | | |
|---|---|---|---|
| DE | 3101310 | A1 | 12/1981 |
| DE | 3918311 | A1 | 12/1989 |
| DE | 3914595 | A1 | 11/1990 |
| DE | 20101909.4 | U1 | 6/2002 |
| DE | 102005037916 | A1 | 5/2006 |
| DE | 102005003783 | A1 | 8/2006 |
| DE | 102005062609 | A1 | 7/2007 |
| DE | 202007018900 | U1 | 8/2009 |
| DE | 102010037770 | A1 | 3/2012 |
| DE | 102011000205 | A1 | 7/2012 |
| DE | 102012024176 | A1 | 6/2014 |
| EP | 0621184 | A1 | 10/1994 |
| EP | 0653352 | A1 | 5/1995 |
| EP | 0811554 | A1 | 12/1997 |
| EP | 1033305 | A1 | 9/2000 |
| EP | 1060988 | A1 | 12/2000 |
| EP | 1097867 | A1 | 5/2001 |
| EP | 1266828 | A1 | 12/2002 |
| EP | 1266829 | A1 | 12/2002 |
| EP | 1454827 | A2 | 9/2004 |
| EP | 1542192 | A1 | 6/2005 |
| EP | 1574432 | A1 | 9/2005 |
| EP | 2060492 | A1 | 5/2009 |
| EP | 2069209 | A1 | 6/2009 |
| EP | 2199214 | A1 | 6/2010 |
| EP | 2792599 | A1 | 10/2014 |
| FI | 78433 | B | 4/1989 |
| FI | 91624 | B | 4/1994 |
| FR | 1396355 | A | 4/1965 |
| GB | 2395165 | A | 5/2004 |
| JP | 2002104308 | A | 4/2002 |
| JP | 2013154956 | A | 8/2013 |
| WO | 0212065 | A1 | 2/2002 |
| WO | 2004045952 | A1 | 6/2004 |
| WO | 2006085147 | A2 | 8/2006 |
| WO | 2006110596 | A1 | 10/2006 |
| WO | 2008031449 | A1 | 3/2008 |
| WO | 2010078915 | A1 | 7/2010 |
| WO | 2012027705 | A2 | 3/2012 |

OTHER PUBLICATIONS

European Patent Office, "Examination Report", from European Application No. 16151132.4 (5 pages), dated Jun. 17, 2016.

* cited by examiner

PACKAGING APPARATUS AND METHOD FOR OPERATING SAME

This patent application is a continuation of, claims priority to and the benefit of U.S. patent application Ser. No. 16/391,496, filed on Apr. 23, 2019, which is a continuation of, claims priority to and the benefit of U.S. patent application Ser. No. 15/007,634, filed on Jan. 27, 2016, now U.S. Pat. No. 10,273,031, granted on Apr. 30, 2019, which claims priority to and the benefit of German Patent Application No. 10 2015 101 489.0, filed on Feb. 2, 2015, the entire contents of each of which are incorporated herein by reference.

The present disclosure relates to a packaging apparatus for packaging at least one article with a tubular film to be pulled over the article and a method for operating such a packaging apparatus.

For this purpose, the packaging apparatus has a machine frame on which a film supply apparatus, a film covering apparatus that is movable in the vertical direction, and a drive for moving the film covering apparatus are arranged. Packaging apparatuses of this type are known and are referred to, depending on the design, as a stretch hood system or a shrink hood system.

In general, such packaging apparatuses are used for securing articles on a pallet by way of a film, also to protect the articles from external influences. However, the packaging may also take place without a pallet. The film used is generally a highly stretchable plastic tube that is pulled from above over the article. The film supply apparatus ensures that the tubular film is available to the film covering apparatus in the required length. The severed piece of film is subsequently taken over by the film covering apparatus. The film covering apparatus customarily has reefing fingers that expand the elastic film tube by moving the elastic film tube apart until the film tube can be pulled over the article. For this purpose, the film covering apparatus moves downward, with the expanded film tube then being pulled (by way of reefing rollers) off the reefing fingers onto the article. In the case of a stretch hood system, the elastic film contracts again after being pulled off the reefing fingers and thus secures the article. In the case of the shrink hood method, the film is shrunk on by heating.

To be able to move the film covering apparatus in at least one desired direction (generally vertically, but movements in other directions, for example in a horizontal direction for maintenance in a lateral position of the machine frame, are also conceivable), the known apparatuses generally have at least one drive. The drive can have a piston and/or a motor. The piston and/or the motor then drives a belt, a chain, a cable, a linkage, or the like that is operatively connected with the film covering apparatus.

As a rule, the film supply apparatus has subcomponents, such as a film store, a film feed apparatus, a film opening apparatus, a cutting apparatus, and/or a welding apparatus.

The film store is understood here as meaning any type of reservoir in which film is stored. This can be, for example, a film reel from which a required piece of film is unwound.

The film feed apparatus has rollers that are generally driven and that, by way of the rotation thereof, transport further film.

The film opening apparatus can be formed, for example, from "suction boxes". The "suction boxes" generate a suction force and thereby ensure that the film is opened. However, mechanical solutions, such as grippers with which the film is opened, are also conceivable. The reefing fingers of the film covering apparatus can then later engage from the inside into the opened film tube.

The cutting apparatus then severs the required portion of the film tube from the remainder thereof. This can take place, for example, with a knife or a thermal cutting wire.

The welding apparatus permits welding of the cut-off end of the film tube. A film hood can thus be produced. Such a film hood protects the article even better upward and also permits the application of vertical retaining forces to the article.

The film supply apparatus and the subcomponents thereof are generally arranged on the machine frame at least for the most part above the article to be packaged. However, for maintenance or repair purposes, it is occasionally necessary for a fitter to approach the film supply apparatus or the subcomponents thereof to be able to carry out work there. Since the film supply apparatus or the subcomponents thereof is or are generally located at a height of some meters above the ground, such maintenance is frequently laborious and possibly also dangerous since the fitter could fall off Therefore, conventional apparatuses have working platforms with a safety barrier. However, these require space and cause additional costs in production.

EP 2069206 B1 proposes a packaging apparatus in which the film advancing device can be moved downward to maintain the film advancing device close to the ground. For this purpose, the film advancing device either has a dedicated drive for the downward movement or the film advancing device is connected to the film covering apparatus and is then moved downwards with the film covering apparatus by "piggyback" into the maintenance position.

The two solutions have proven highly practicable, but require additional and/or specially adapted components. If the film advancing device has a dedicated drive for the downward movement, additional components are required for this purpose and make the system more complicated and expensive. If the film advancing device is moved by way of the film covering apparatus by "piggyback," all of the components of the drive of the film covering apparatus have to be of such large dimensions that the film covering apparatus is also not overloaded by the additional weight of the film advancing device. However, both because of the larger dimensioning and because of the use of additional components, the production costs of the packaging apparatus increase. This is generally not desirable.

It is therefore the object of the present disclosure to reduce the production costs of such a packaging apparatus mentioned at the beginning.

This object is achieved by a packaging apparatus and by a method for operating such a packaging apparatus.

The packaging apparatus of the present disclosure is distinguished in that the packaging apparatus has at least one releasable drive coupling that is designed in such a manner that the drive can be brought into operative connection optionally either with the film covering apparatus or with at least one subcomponent of the film supply apparatus in such a manner that then either the film covering apparatus or at least the relevant subcomponent of the film supply apparatus can be moved on the machine frame by the drive.

The drive coupling here can have an abundance of conceivable design forms and mechanisms. For example, mechanical couplings or electromagnetic couplings are conceivable. One main feature is that the drive of the film covering apparatus can be released from the film covering apparatus and subsequently can be brought into engagement with at least one subcomponent of the film supply apparatus. It is mainly made possible by way of such a releasable drive coupling that both film covering apparatus and film supply apparatus can be moved by the drive of the film covering apparatus, specifically one after the other. This firstly affords the advantage that all of the components of the drive do not have to be configured in duplicate. On the contrary, the drive of the film covering apparatus can be directly used to also move the film supply apparatus or a subcomponent thereof into a maintenance position.

The drive can thus be of small dimensions. This is because the dimensioning of all of the drive components no longer has to be configured to move the overall weight of film covering apparatus and film supply apparatus, but rather is merely based on the heaviest individual component in each case to be transported. The smaller dimensioning of the drive components makes it possible to reduce the production costs of the packaging apparatuses. In addition, it is thus possible to design the packaging apparatus to be overall slimmer and lighter.

In an embodiment, the releasable drive coupling is designed in such a manner that, by actuation of the drive coupling, each existing operative connection of the drive with the film covering apparatus or with at least one subcomponent of the film supply apparatus can be undone. The drive can thus be changed in a very simple manner.

The film supply apparatus expediently has, as a subcomponent, at least one of the subcomponents already explained previously, such as a film store, a film feed apparatus, a film opening apparatus, a cutting apparatus, and/or a welding apparatus.

Each of these subcomponents has to occasionally be maintained or repaired. This is possible in a simple and safe manner by way of the packaging apparatus according to the present disclosure, since the subcomponents can be moved together, or else individually, into a maintenance position that is easy to reach, for example in the lower region of the machine frame. This increases the safety during work on the apparatus and the work can take place rapidly and in a straightforward manner.

It may be expedient here for a plurality of subcomponents of the film supply apparatus to be able to be moved together or separately from one another. This should be understood in such a manner that, for example, first of all the film feed apparatus and the film opening apparatus are moved into a maintenance position and subsequently the cutting apparatus and the welding apparatus are moved into the maintenance position in a separate step. The separate movement of the subcomponents affords the advantage that the drive components can be dimensioned to be slimmer and smaller. This is in particular the case if the weight of a plurality of subcomponents together exceeds the weight of the film covering apparatus.

Expediently, the packaging apparatus has at least one releasable first positioning coupling device with which at least one subcomponent of the film supply apparatus can be fixed on the machine frame. The first positioning coupling device is understood here as meaning any device that makes it possible to fasten the at least one subcomponent to the machine frame. This can take place, for example, by way of clamping jaws that are clamped mechanically, hydraulically, pneumatically, or electrically to the machine frame. In addition to such a frictional connection, positive connections that are produced, by, for example, latching lugs or pivoted levers, are also conceivable. Furthermore, connections that are produced, for example, by solenoids are also conceivable. By way of such a positioning coupling device, the subcomponent is then held on the machine frame in the operating mode of the packaging apparatus. In the operating mode of the system, i.e., when an article is being packaged, the subcomponents of the film supply apparatus have to be securely connected to the machine frame so that the system is functional. So that the at least one subcomponent can then also be moved into a maintenance position, the corresponding positioning coupling device, however, also has to be releasable. Only thus is a release of the connection for letting down the at least one subcomponent possible. Even in the maintenance position, it may then be expedient for at least one subcomponent to be fixedly connected to the machine frame. The drive is thereby relieved of load during the work on the apparatus. In addition, the safety during the work is thus also increased since a basically conceivable sagging of the at least one subcomponent, for example in the event of a power failure of the drive, is prevented.

The packaging apparatus advantageously has at least one releasable second positioning coupling device with which the film covering apparatus can be fixed on the machine frame. The second positioning coupling device, like the first positioning coupling device, can have a multiplicity of possible embodiments. Here too, positive, frictional or non-positive connections that, for example, come into engagement mechanically, electrically, pneumatically, or hydraulically, are again possible. The arrangement of a releasable second positioning coupling device on the film covering apparatus affords the advantage that the film covering apparatus can thereby be secured at a defined position of the machine frame. This is firstly necessary since, according to the present disclosure, the drive is separated from the film covering apparatus in order subsequently to move the film supply apparatus or at least a subcomponent thereof. In the separated state, the weight of the film covering apparatus is transported by the second positioning coupling device to the machine frame. A fixed and secure position of the film covering apparatus is thus ensured.

It may be expedient here for at least one positioning coupling device to be designed in such a manner that fixing of the film covering apparatus and/or of the at least one subcomponent of the film supply apparatus to the machine frame at different positions is possible. First of all the film covering apparatus can thus be moved to a desired height and secured there on the frame with the positioning coupling device. Subsequently, at least one subcomponent of the film supply apparatus, such as a cutting knife, can be moved into a desired maintenance position and secured there with the machine frame. After the work to the relevant subcomponent has been carried out, the subcomponent can then be moved in such a manner that work on a further subcomponent, for example the film opening apparatus, is possible at that position. It is therefore possible for the film covering apparatus or subcomponents to be brought into freely selectable positions. Depending on work to be carried out, these can be different positions on the machine frame. As a result, ergonomic, rapid, and safe work on at least one subcomponent of the film supply apparatus and the film covering apparatus is ensured.

In a development, it may be advantageous for the packaging apparatus to have at least one mounting on which the film covering apparatus can be deposited. The film covering apparatus can sit, for example in the maintenance position thereof, on at least one bearing block and can thus be secured by gravity. The mounting can be a stop on which the movable film covering apparatus sits when the film covering apparatus has been moved completely downward in the machine frame.

The drive expediently has at least one piston and/or a motor and at least one drive chain, drive cable, linkage, and/or drive belt operatively connected thereto. In particular, the combination of drive chain/drive belt/drive cable with a motor is particularly advantageous since the driven parts of the apparatus can also be moved here over large distances. In addition, such an arrangement provides the possibility of connecting a transmission between motor and drive chain/drive belt/drive cable to achieve a desired transmission ratio. Drive chain, drive cable or drive belt, or the mounting thereof on deflecting rollers, can then be configured in a targeted manner to the weight of the film covering apparatus to be transported or to the respective subcomponent of the film supply apparatus. A particularly slim and light design of the machine frame is thus possible. In addition, a chain affords the advantage that the individual links of the chain can also be directly connected to the releasable drive coupling. For example, a pin on the film covering apparatus can engage in a chain link in order thereby to produce the operative connection. The same then also applies to the operative connection between at least one subcomponent of the film supply apparatus and drive.

Furthermore, it may, however, also be advantageous for the drive coupling to have at least one drive coupling device that is arranged on the drive chain and/or on the drive belt. For example, an extendable toggle lever can be fastened to the drive chain or to the drive belt, the toggle lever, in the extended state, coming into operative connection with film covering apparatus or at least a subcomponent of the film supply apparatus and, by way of retraction, also being able to be released again. The fastening of the drive coupling device to the drive chain or to the belt affords the advantage that such a movable device does not have to be mounted in each case on the subcomponent or the film covering apparatus. On the contrary, a single device on the drive is sufficient. As a result, the number of parts of the packaging apparatus can be reduced, which ultimately reduces the production costs.

Alternatively, it may, however, also be expedient for the drive coupling to have at least one drive coupling device that is arranged on the film covering apparatus and/or at least on a subcomponent of the film supply apparatus. Such an arrangement affords the advantage that the drive chain or the drive belt can be of very slim design and a bulky apparatus does not have to be mounted here.

Furthermore, it may be advantageous for at least one drive coupling device to have a pivotable or a rigid catch lever. The operative connection between drive and film covering apparatus or at least one subcomponent of the film supply apparatus can be produced by way of such a catch lever. In the case of a pivotable catch lever, the operative connection can be produced here via the change in position of the lever. By pivoting of the catch lever, the catch lever is brought into engagement in a targeted manner. The pivoting can take place either via hydraulics, pneumatically, or via electric drives. By way of the pivoting of the catch lever, the operative connection can therefore be closed and released in a targeted manner.

It may be advantageous here for at least one drive coupling device to be designed as a counterpart to the catch lever. The drive coupling device cannot come into connection with any component of the counterpart to produce the operative connection, but rather a specifically configured component is mounted here. For example, a drive coupling device that is designed as a counterpart to the catch lever can be seen in a thickened portion on the drive chain or the drive belt, which thickened portion can come into engagement with a recess on the fixed catch lever.

Also for the pivotable catch lever, drive coupling devices as the counterpart are conceivable in many forms, for example in the form of a milled portion, in which the catch lever can engage. It is important for the counterpart to be shaped in such a manner that secure engagement of the catch lever is permitted and therefore slipping away or the like is prevented.

The catch lever here is expediently designed in such a manner that the film covering apparatus or at least one subcomponent of the film supply apparatus can be raised with the catch lever. This can take place by the fact that the catch lever acts from below on the film covering apparatus or the subcomponent and, on further upward movement of the drive, by way of a non-positive connection provides for the raising of the component. In this case, a fixed connection is not absolutely necessary. A particularly more simple design of the drive coupling is thus provided.

It may be advantageous for at least one positioning coupling device to be designed in such a manner that the operative connection of the machine frame can be released by raising the covering apparatus or the at least one subcomponent of the film supply apparatus. The position coupling device can thus be pre-tensioned, for example by a spring, and pushed in the direction of the machine frame when the positioning coupling device is in engagement. As soon as the film covering apparatus or the film supply apparatus or the subcomponent thereof is raised by the drive, the positioning coupling device snaps in the direction of the machine frame because of the pre-tensioning of the spring and releases the operative connection between machine frame and covering apparatus or film supply apparatus. A mechanism that is released when the component itself is raised has the advantage that an additional control of the positioning coupling device is not necessary here. The release of the operative connection of the positioning coupling device is thus ensured in a simple and reliable form. Conversely, the closing of the positioning coupling device can likewise take place by way of a purely mechanical configuration. The positioning coupling device can have, for example, a type of catch that brings the positioning coupling device into engagement again as soon as the covering apparatus or the subcomponent moves past the positioning coupling device from the bottom upward. By way of the moving past from the bottom, the positioning coupling device is therefore mechanically brought into engagement again. Subsequently, the covering apparatus or the film supply apparatus can be deposited again onto the positioning coupling device.

It may be advantageous for the at least one positioning coupling device to have a bolt that can be brought into engagement in a recess on the machine frame to fix the relevant component. It is conceivable here to provide a multiplicity of recesses on the machine frame and thus to permit as flexible a positioning as possible. For this purpose, the film covering apparatus or the film supply apparatus is expediently moved first of all into the preferred maintenance position by way of the drive. At the desired location, the bolt is then brought into engagement in the corresponding recess on the machine frame to secure the film covering apparatus or the film supply apparatus on the machine frame at that position. The fitting of the bolt can take place here manually or else by a corresponding actuator. By way of the design of the positioning coupling device in the form of a bolt that can be brought into engagement with a corresponding recess on the machine frame, a particularly simple embodiment that is particularly low in maintenance is ensured. Firstly, the relevant component is securely fixed in a simple manner. Secondly, a multiplicity of positions are possible for rapid maintenance.

Expediently, the packaging apparatus has a controller that is configured in such a manner that the drive brings the film covering apparatus from an operating position into a maintenance position, the operative connection between film covering apparatus and drive is released there, the drive is then driven in such a manner that the drive coupling device is moved into a position in which the drive coupling device is then brought into operative connection with at least one subcomponent of the film supply apparatus, and then the at least one subcomponent of the film supply apparatus is brought from an operating position into a maintenance position. Film covering apparatus and also the at least one subcomponent of the film supply apparatus are therefore moved in each case separately into the maintenance position thereof by way of the drive of the film covering apparatus. Since the apparatuses and subcomponent are not moved together, but rather one behind another, the drive of the film covering apparatus and the machine frame can be configured and dimensioned to be very slim. The forces that the drive has to absorb are ideally not greater here than the dead-weight of the film covering apparatus. In other words, the drive is optimally dimensioned in respect of the film covering apparatus and the film supply apparatus is subsequently divided into so many subcomponents that the weight of the respective subcomponent does not exceed the weight of the film covering apparatus. It is thus ensured that the drive can also move the relevant subcomponent into a maintenance position without requiring larger dimensioning of the drive components.

The method of the present disclosure is distinguished in that the drive brings the film covering apparatus from an operating position into a maintenance position, the operative connection between film covering apparatus and drive is released there, the drive is then driven in such a manner that the drive coupling device is moved into a position in which the drive coupling device is then brought into operative connection with at least one subcomponent of the film supply apparatus, and then the at least one subcomponent of the film supply apparatus is brought from an operating position into a maintenance position.

Operating position is intended to be understood here as meaning the normal state of the apparatus when the apparatus is in the process of carrying out packaging or at least in principle would be capable of carrying out packaging. Maintenance position should be understood as meaning a position differing from the operating position.

The method according to the present disclosure therefore consists in moving film covering apparatus and at least one subcomponent of the film supply apparatus in a stepwise manner one behind the other from the respective operating position thereof into a maintenance position. For this purpose, according to the present disclosure, use is directly made of the drive of the film covering apparatus. In the operating mode, the film covering apparatus is moved to and fro by the drive thereof in the machine frame to be able to correspondingly pull the packaging film over the article. According to the present disclosure, by way of the drive, the film covering apparatus is now brought from an operating position into a maintenance position and the operative connection is separated there. Only by separating the operative connection is it possible to use the drive also for moving the at least one subcomponent of the film supply apparatus. The advantage of this method according to the present disclosure consists in that a narrow, slim and optimum dimensioning of the drive components, but also of the apparatus as a whole can take place. By way of the stepwise downward movement of film supply apparatus and of at least one subcomponent, the drive does not have to be dimensioned to be larger than is necessary in any case for the movement of the film covering apparatus. A slim, weight- and material-saving design is thereby possible. Accordingly, it is possible to move the film covering apparatus and the subcomponent(s) of the film supply apparatuses into a maintenance position and thus to be able to work safely and ergonomically thereon.

It may be expedient here for the method to be repeatedly carried out in such a manner that the film covering apparatus and/or at least one subcomponent of the film supply apparatus is or are brought into different maintenance positions. This permits an even safer, more efficient, and more ergonomic maintenance of the packaging apparatus. It is thus possible, for example, first of all to move the film covering apparatus into a first maintenance position in which a fitter, for example, can maintain the reefing fingers because the reefing fingers are then precisely located at standing height of the fitter. Subsequently, the film covering apparatus is then, for example, entirely lowered and subsequently, for example, the cutting apparatus is lowered to the extent required by the fitter. The optimum position in each case can then be approached also for further components of the film supply apparatus. Safe, rapid, and efficient maintenance of the system is thereby possible.

The present disclosure is explained in more detail below with reference to an exemplary embodiment illustrated schematically in the drawings.

Figure 1:
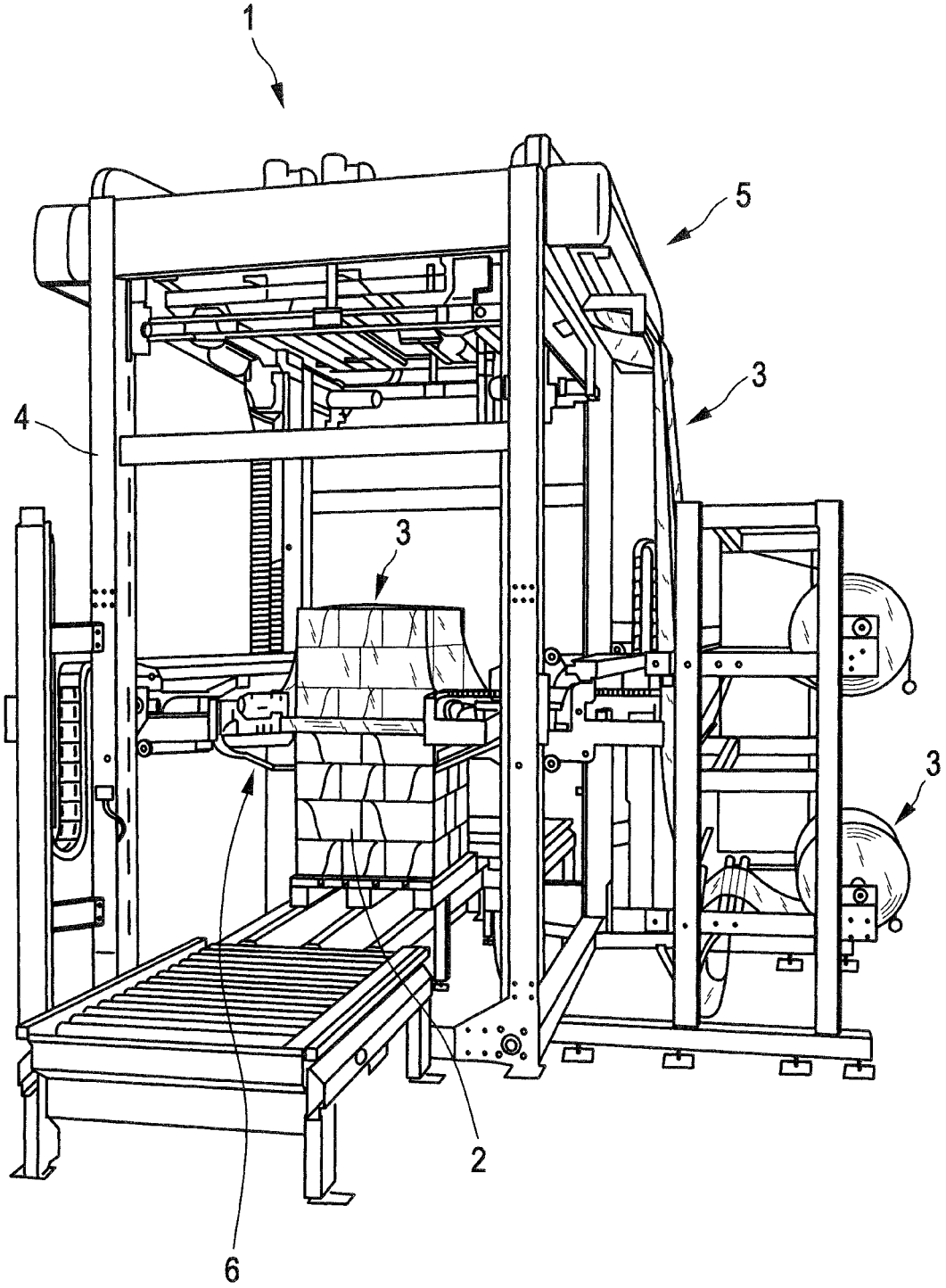
FIG. 1 shows a perspective overall view of a packaging apparatus of the present disclosure.

FIG. 1 shows a perspective overall view of a packaging apparatus 1 of the present disclosure for packaging an article 2 with a tubular film 3. The packaging apparatus 1 has a film stock in the form of a rolled tubular film 3. To produce and feed in the film, the packaging apparatus 1 has a film supply apparatus 5 that is arranged in the upper region of a machine frame 4 of the packaging apparatus 1. The film supply apparatus 5 has subcomponents, such as film feed apparatus, film opening apparatus, cutting apparatus, and welding apparatus (not illustrated explicitly).

For maintenance and/or installation purposes, it is sometimes necessary here to move the film covering apparatus 6 and/or the film supply apparatus 5 or a subcomponent of the film supply apparatus 5 into a maintenance position. Since the packaging apparatus 1 is generally some meters high, it is difficult, under some circumstances, for a fitter to reach all of the components of the packaging apparatus 1. Therefore, according to the present disclosure, both the film covering apparatus 6 and at least one subcomponent of the film supply apparatus 5 can be moved into a maintenance position, as shown in FIG. 2 to FIG. 17.

It is now first of all explained in FIG. 2 to FIG. 8 how the film covering apparatus 6 is moved by way of the drive 7 into a maintenance position. It is subsequently explained in FIG. 9 to FIG. 17 how the film supply apparatus 5 or the subcomponent thereof is subsequently also moved by way of the drive 7 into a maintenance position.

Figure 2:
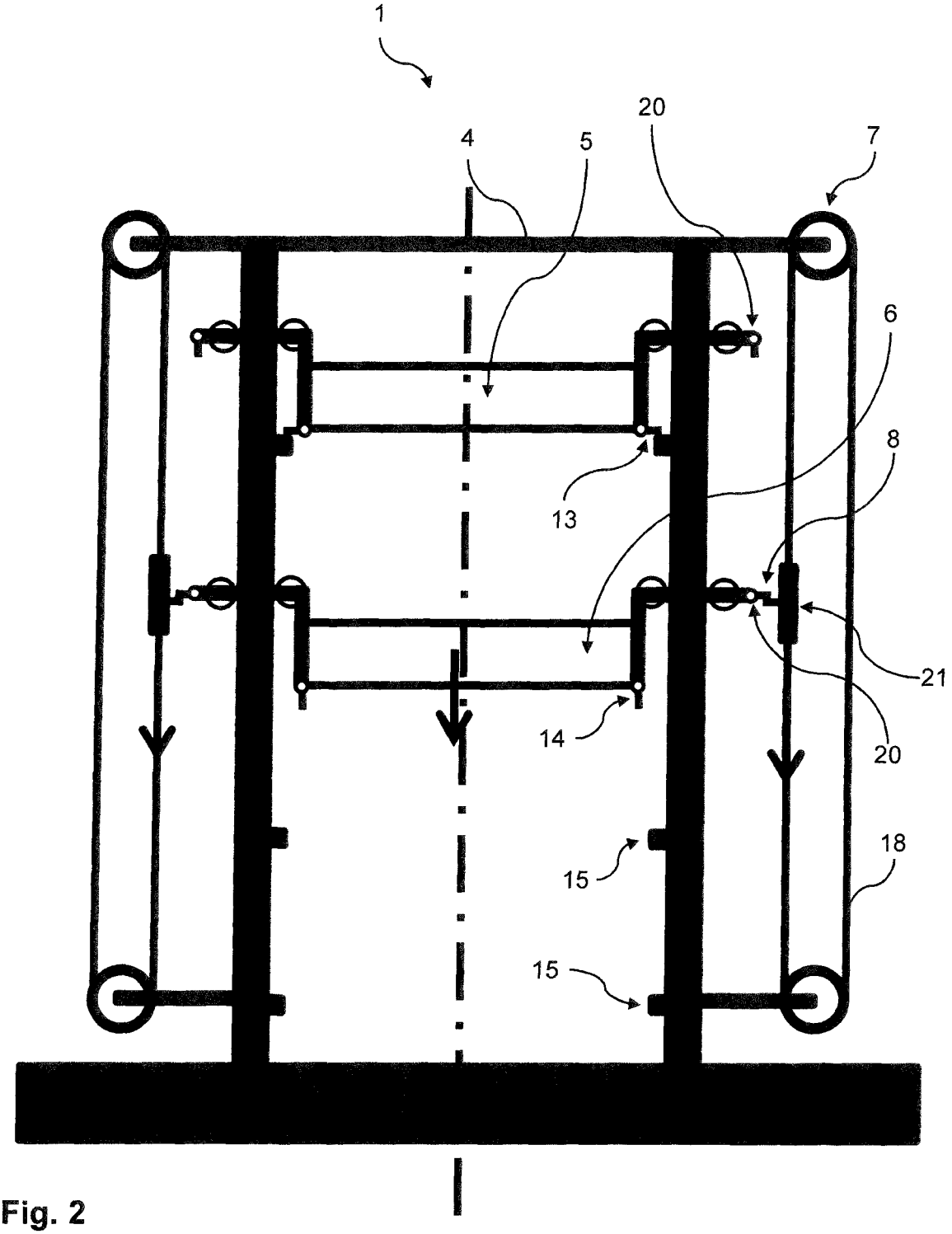
FIG. 2 to FIG. 8 show a simplified side view of a packaging apparatus of the present disclosure, showing the individual steps of lowering the film covering apparatus from an operating position into a maintenance position.

FIG. 2 shows a side view of the packaging apparatus 1 with the machine frame 4. The film covering apparatus 6 is fastened to the machine frame 4 so as to be movable in a vertical direction. The film covering apparatus 6 is connected to a drive belt 18 of a drive 7 by way of a drive coupling 8. However, solutions with a drive cable and/or a drive belt are also conceivable. The drive 7 can take place here by motor or else hydraulically and/or pneumatically by way of a drive piston. The drive can be arranged at the top or at the bottom or at another suitable position of the machine frame 4.

In the present example, the drive coupling 8 has a catch lever 20 that is mounted on the film covering apparatus 6. A counterpart 21, for example a bushing, that is in engagement with the catch lever 20 when the catch lever 20 is in an extended state is mounted on the drive belt/chain/cable 18. In FIG. 2, the catch lever 20 is in the extended state and is therefore inoperative connection with the counterpart 21. By way of the drive coupling 8, it is therefore possible to move the film covering apparatus 6 on the machine frame 6.

Figure 3:
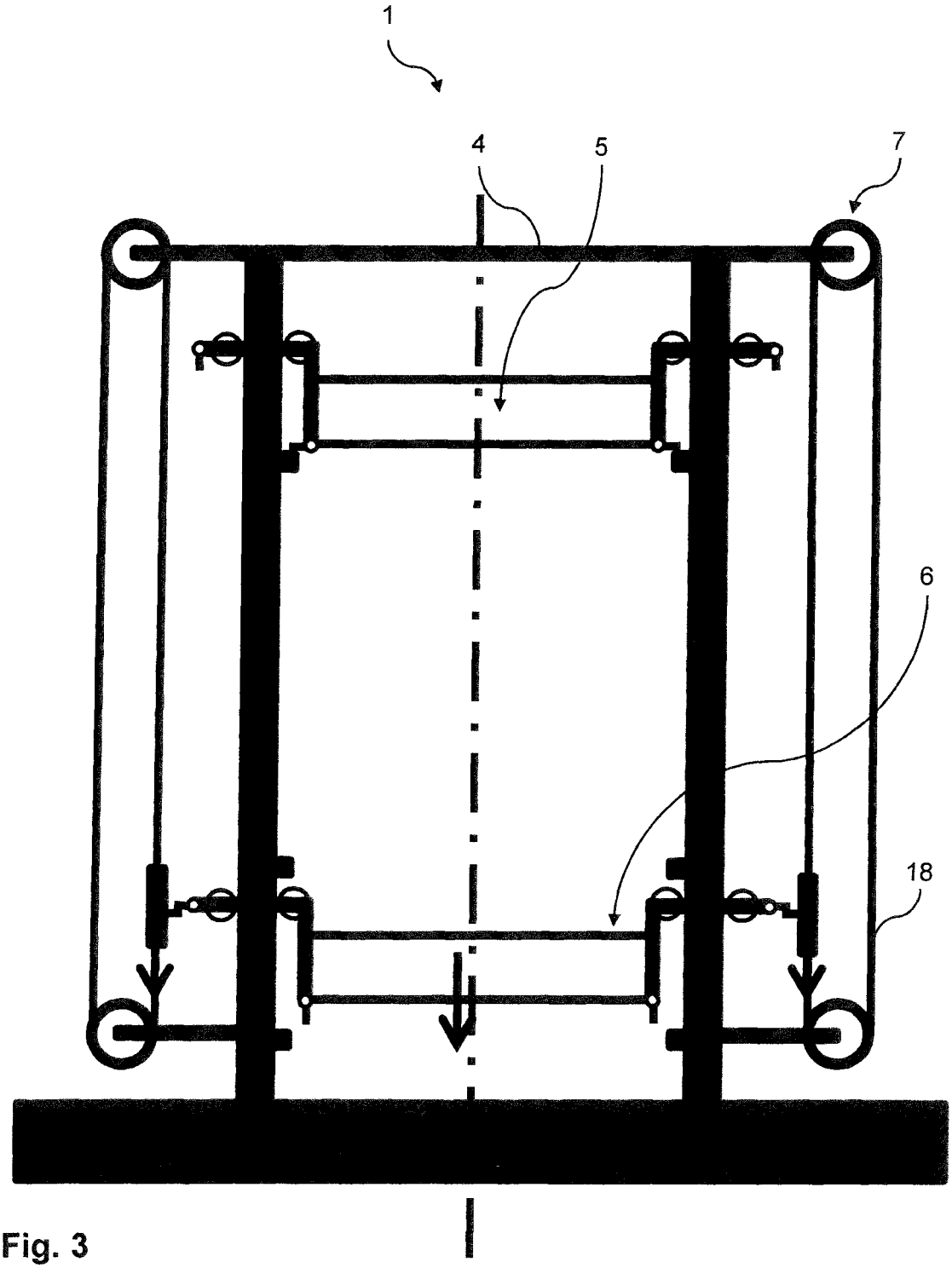

FIG. 3 shows a schematic side view according to FIG. 2, wherein the film covering apparatus 6 is now in a lowered position and is intended to be brought into a maintenance position.

Figure 4:
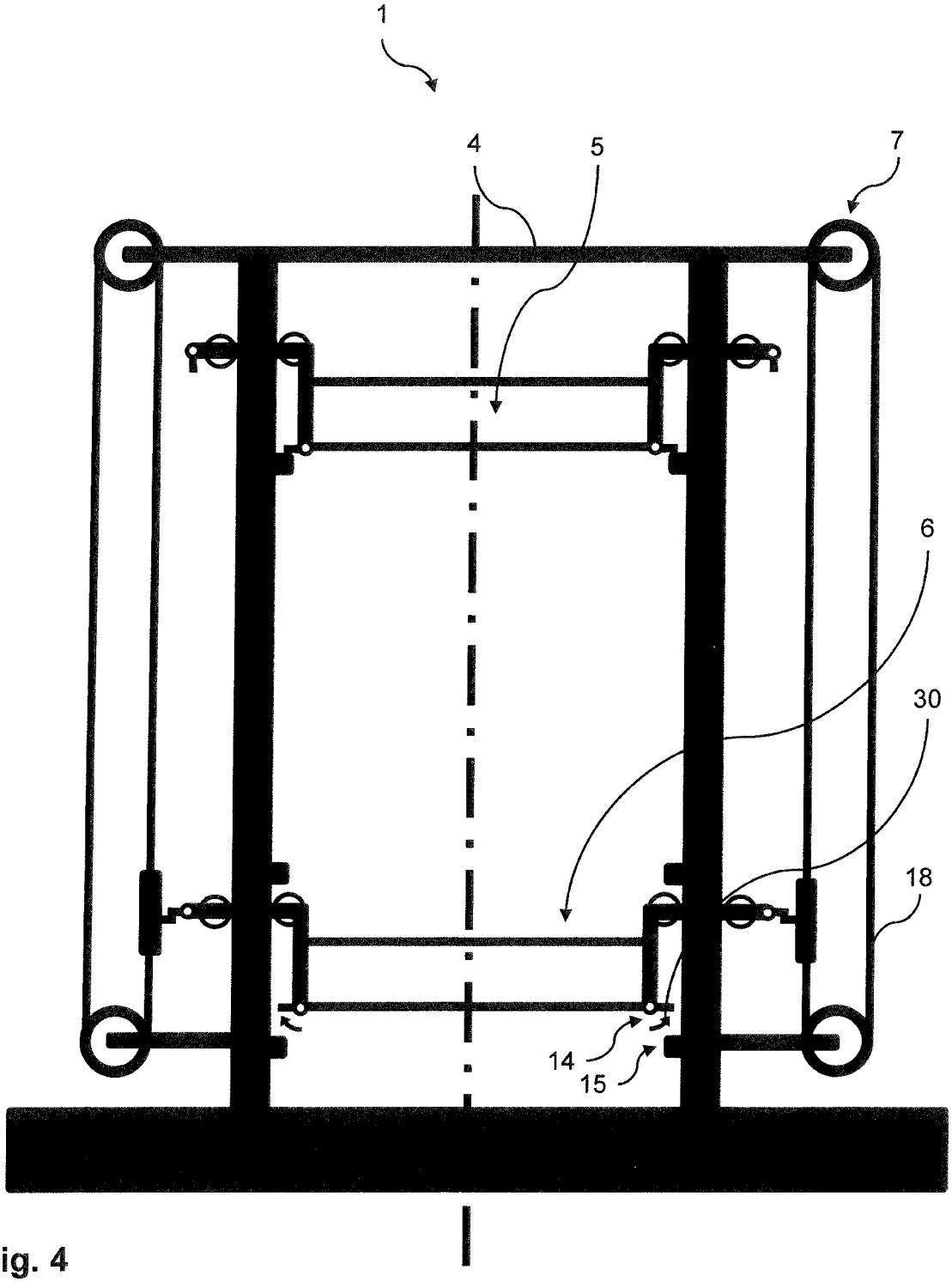

As can be seen in FIG. 4, the film covering apparatus 6 has positioning coupling devices 14. In the present exemplary embodiment, these are pivotable levers that can be moved, for example, by a hydraulic drive (not illustrated). The movable levers are activated via a controller of the packaging apparatus. As indicated in FIG. 4 by the curved arrows 30, the positioning coupling devices 14 of the film covering apparatus 6 are moved into an engagement position. However, the positioning coupling devices 14 do not absolutely have to be formed by movable parts of this type. Instead of the pivotable lever, it is thus also possible, for example, for a rigid projection also to be arranged on the film covering apparatus 6.

Figure 5:
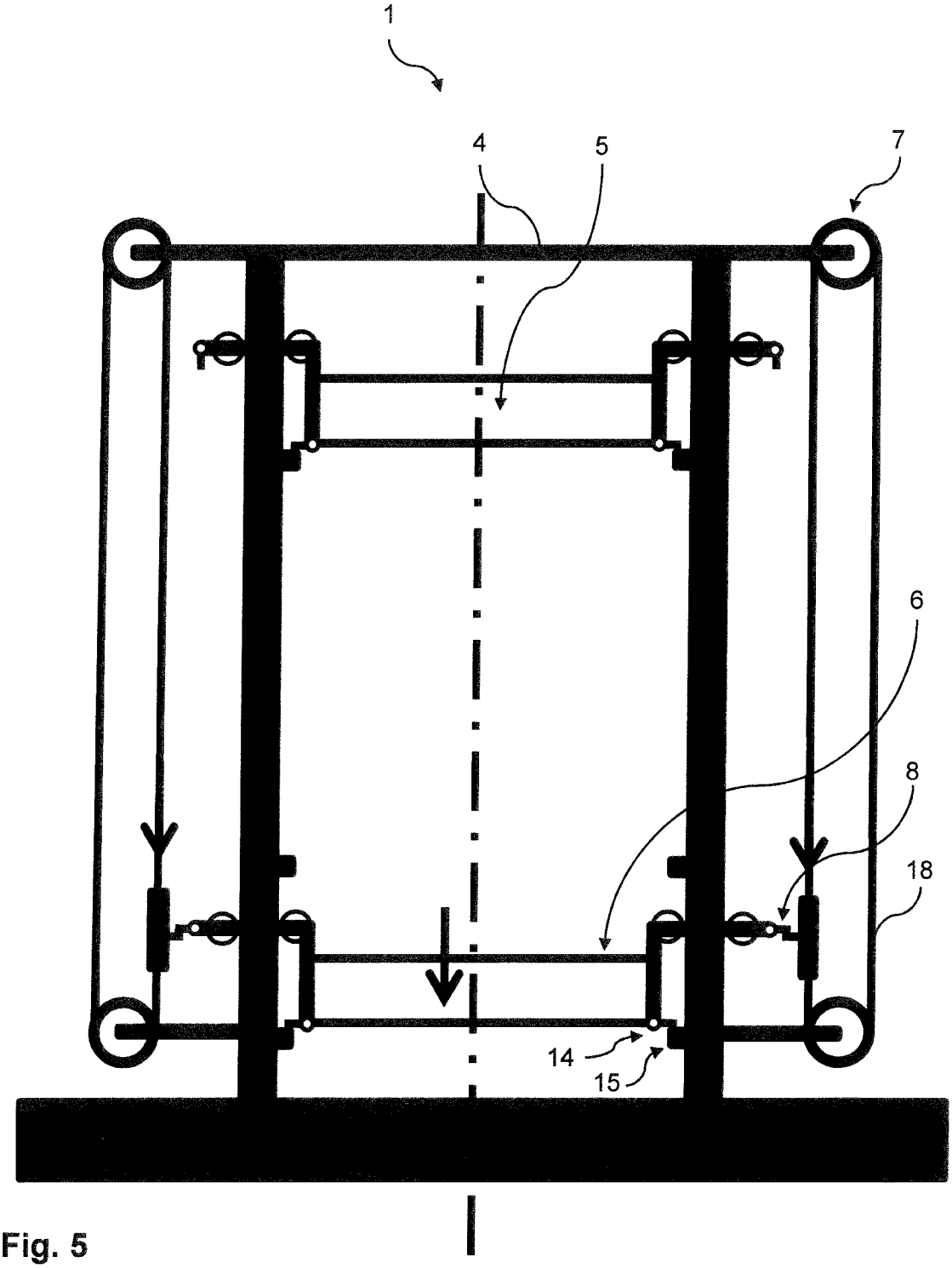

As illustrated in FIG. 5, the film covering apparatus 6 is subsequently lowered further by way of the drive 7, as a result of which the positioning coupling devices 14 sit on mountings 15 mounted on the machine frame 4. The film covering apparatus 6 is now in the maintenance position thereof. If, instead of the pivotable lever, for example a rigid projection is arranged on the film covering apparatus 6, the projection sits correspondingly on the mounting 15. However, instead of on the mounting 15 on the machine frame 4, it may optionally also be expedient for the film covering apparatus 6 to be deposited directly on a surface located under the film covering apparatus 1, for example on the floor of a workshop.

Figure 6:
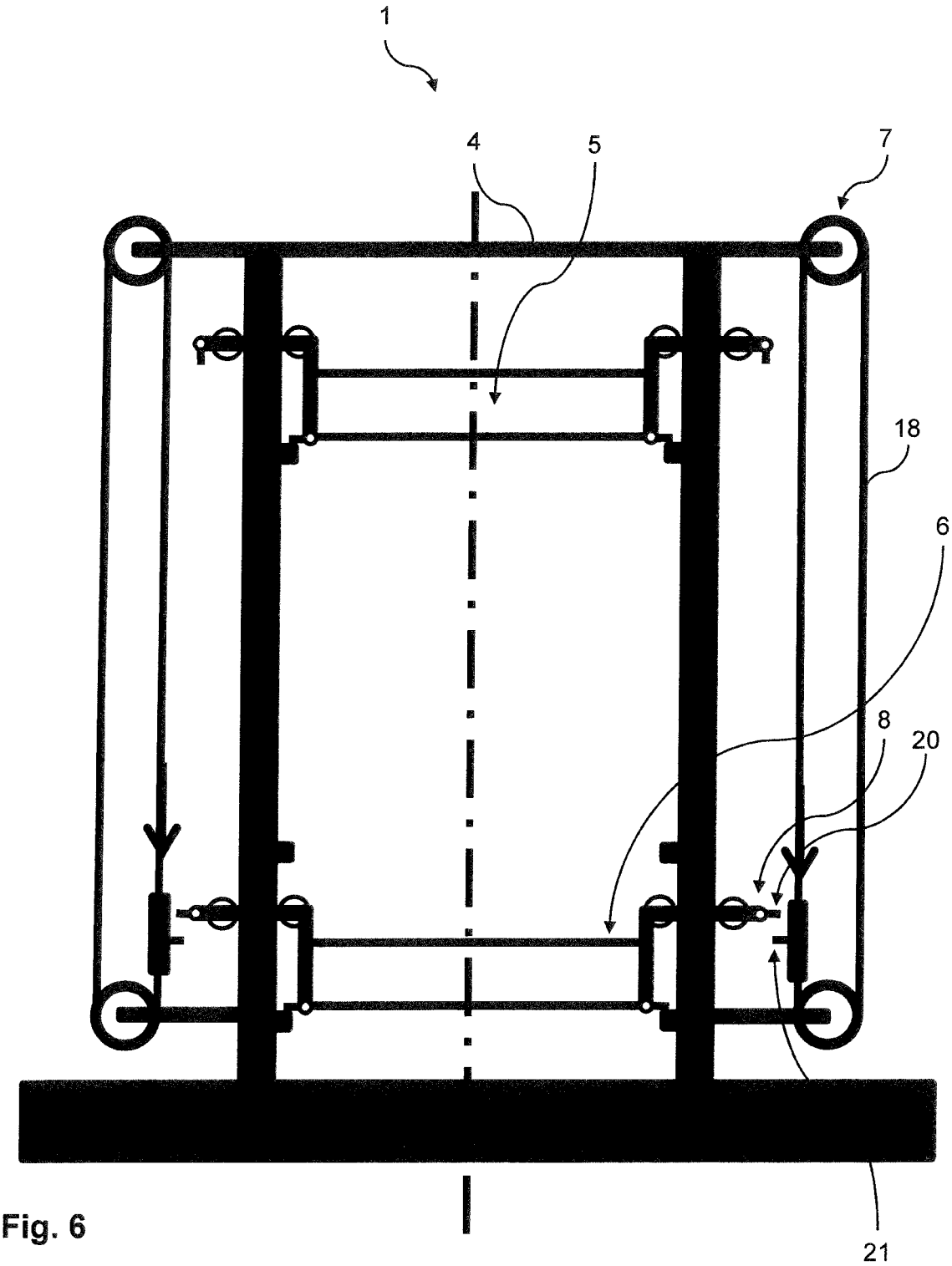

As can be seen in FIG. 6, the operative connection between drive 7 and film covering apparatus 6 is released as soon as the film covering apparatus 6 is in the maintenance position thereof. The drive coupling 8 is responsible for this purpose. In the present case, the drive 7 initially moves further downward by a distance in order thereby to relieve the catch lever 20 of load.

Figure 7:
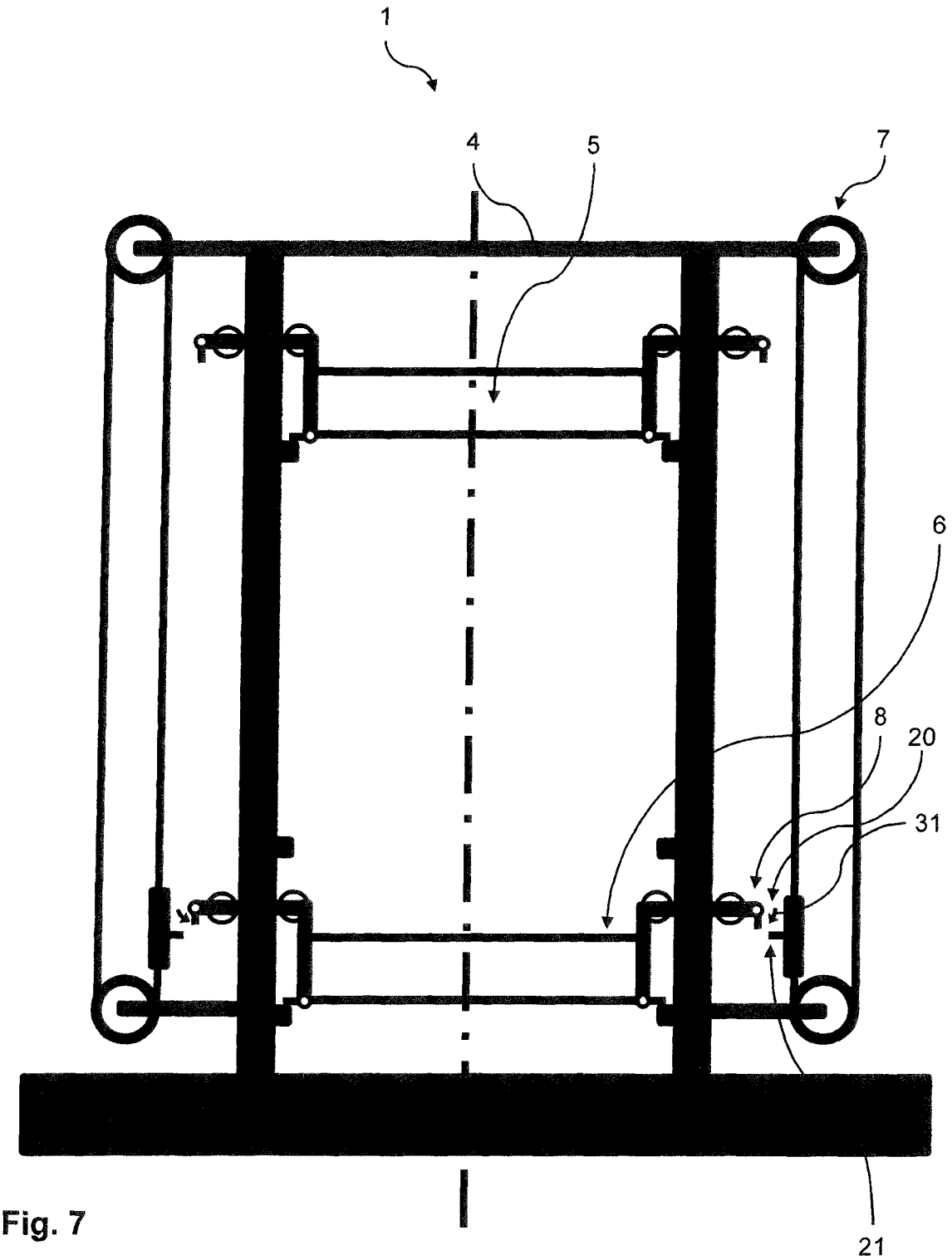
Figure 8:
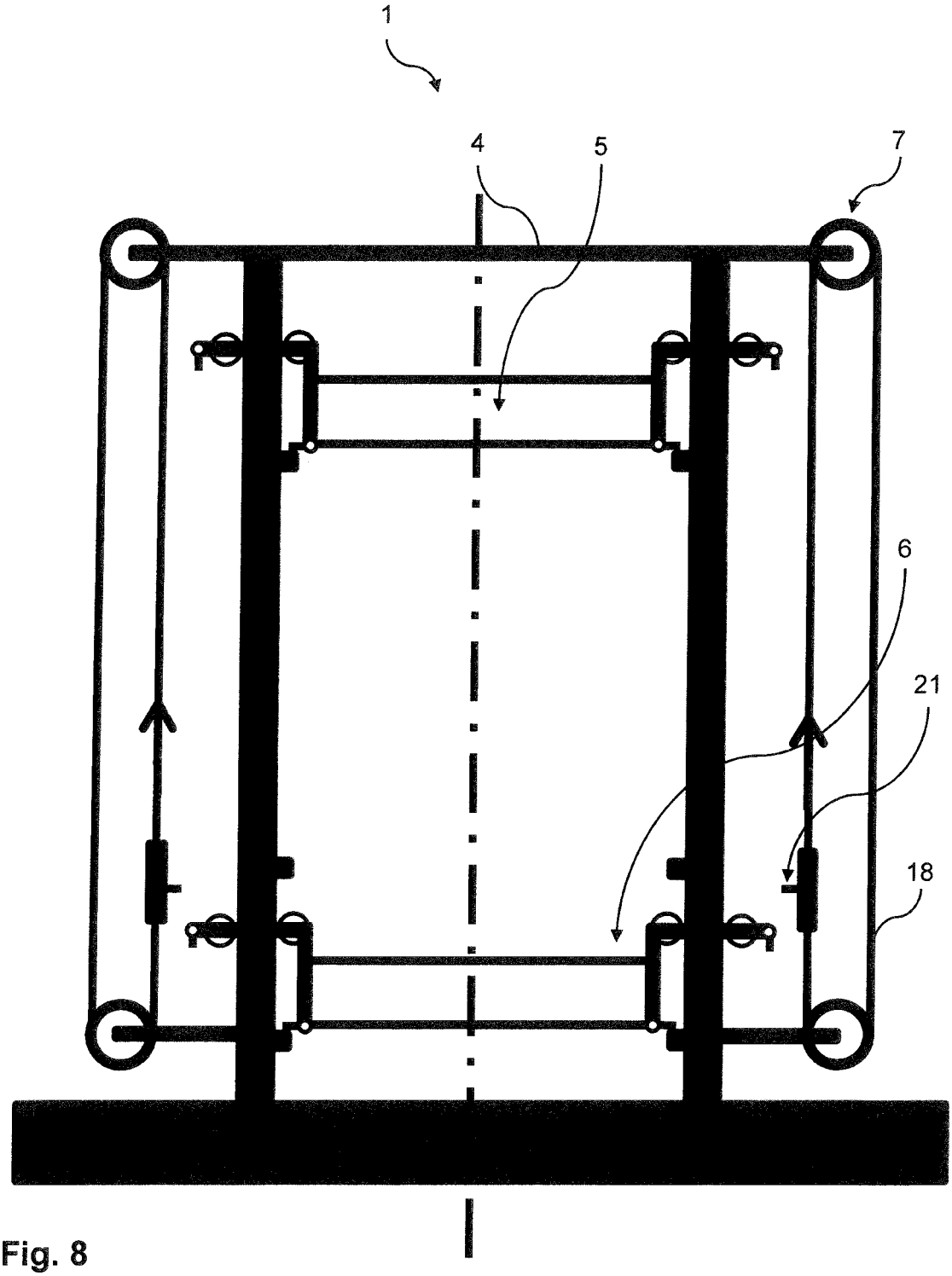

As can be seen in FIG. 7, the catch lever 20 of the film covering apparatus 6 is subsequently moved into a retracted position, as is indicated by the curved arrows 31. This takes place, for example, by way of a pneumatic piston that is connected (not illustrated) to the pivotable catch lever 20. By the pivoting of the catch levers 20 into a retracted position, it is subsequently possible to move the drive 7 together with counterpart 21 upwards on the machine frame 4 without the drive transporting the film covering apparatus 6 upward at the same time. On the contrary, the film covering apparatus 6 continues to remain in the maintenance position thereof, as can be seen in FIG. 8.

It is now explained in FIG. 9 to FIG. 17 how the film supply apparatus 5 or a subcomponent of the film supply apparatus 5 is now also moved by way of the drive 7 into a maintenance position.

Figure 9:
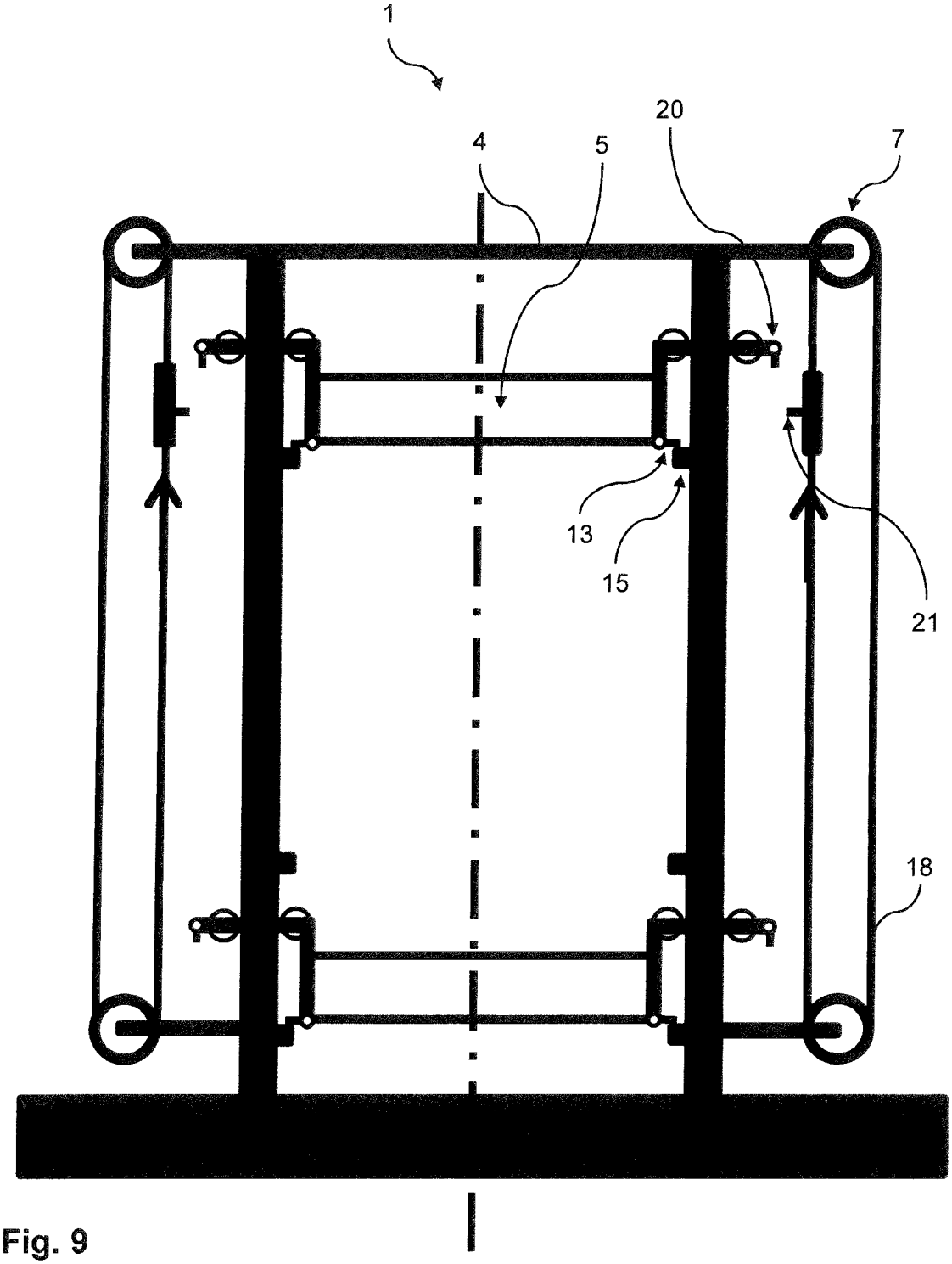
FIG. 9 to FIG. 17 show a simplified side view of a packaging apparatus of the present disclosure, showing the individual steps of the lowering of the film supply apparatus from an operating position into a maintenance position.

In FIG. 9, the film supply apparatus 5 is illustrated still in the operating position thereof—and therefore fastened to the upper end of the machine frame 4. To fasten the film supply apparatus 5 to the machine frame 4, use is made of positioning coupling devices 13. These can be pivotable levers that is moved, for example, by way of pneumatics. A controller takes over the targeted activation of the lever. As can be seen in FIG. 9, the positioning coupling devices 13 are initially in an extended state. As a result, the film supply apparatus 5 is inoperative connection with a mounting 15 on the machine frame 4.

Figure 10:
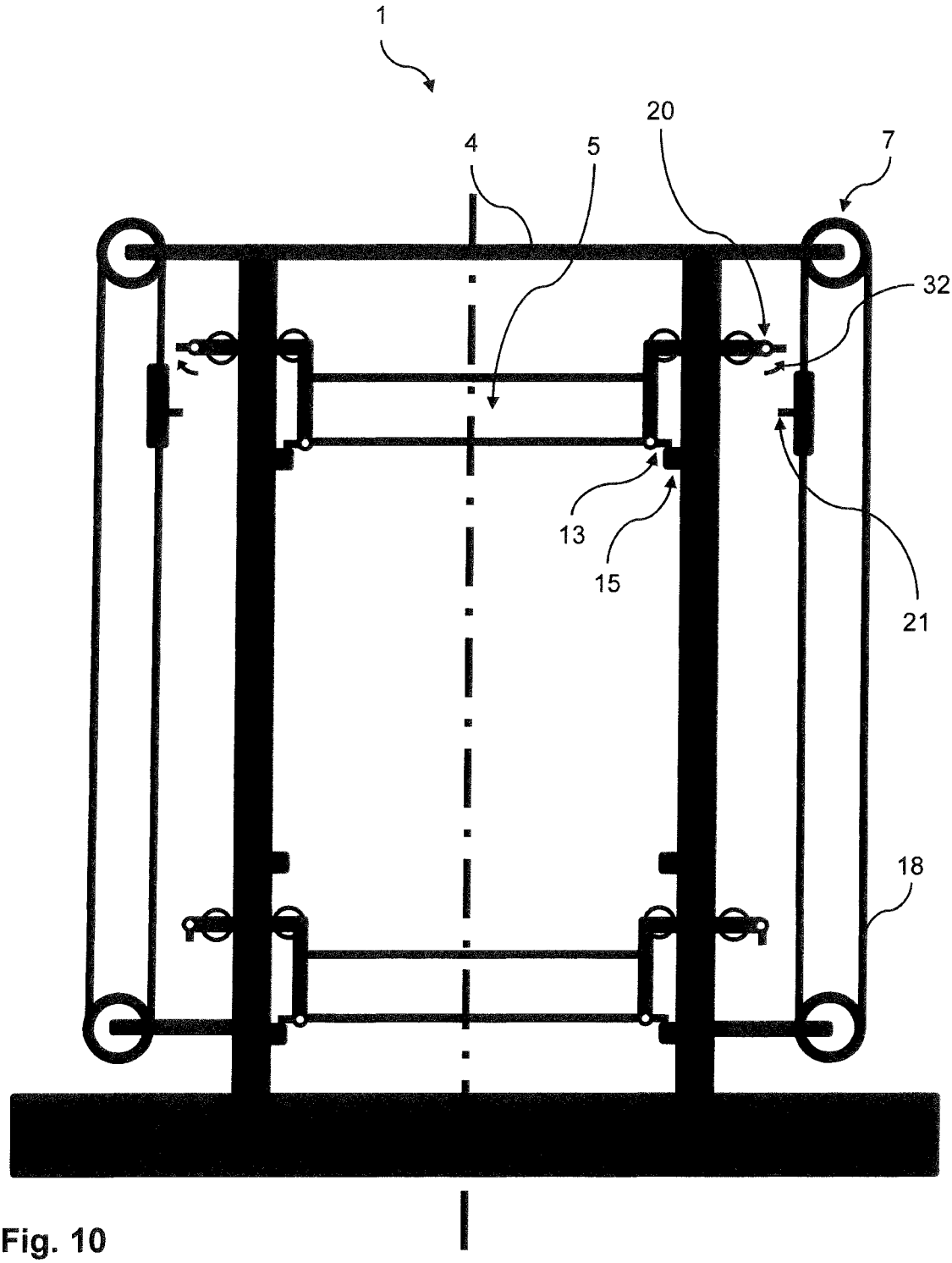
Figure 11:
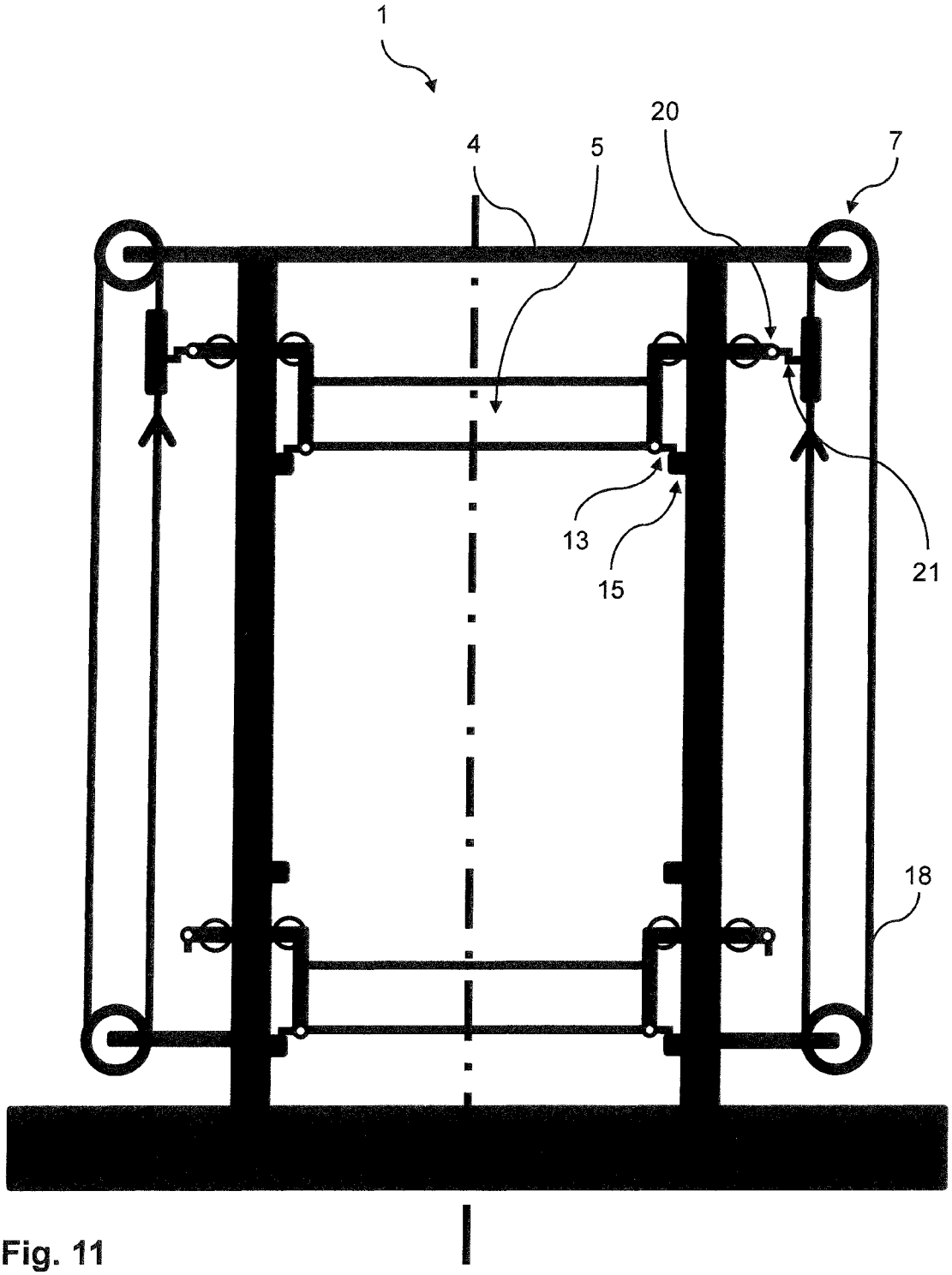

To produce an operative connection between the film supply apparatus 5 and the drive 7, the film supply apparatus 5, similarly to the film covering apparatus 6, has a catch lever 20. The catch lever 20 is also pivotable and is movable in a targeted manner by a controller. To produce the engagement between the catch lever 20 and the drive 7, the catch lever 20 of the film supply apparatus 5 is first of all brought into an extended position. This is illustrated in FIG. 10 and is indicated by the curved arrows 32. Subsequently, the drive 7 together with the counterpart 21 mounted thereon is moved further upward until the catch lever 20 and the counterpart 21 come into engagement. This is illustrated in FIG. 11. However, analogously to the positioning coupling devices 14, the positioning coupling devices 13 also do not absolutely have to be formed by movable parts. Instead of the pivotable lever, it is, for example, also possible for a rigid projection to be arranged on the film supply apparatus 5, which projection comes into engagement with the counterpart 21.

Figure 12:
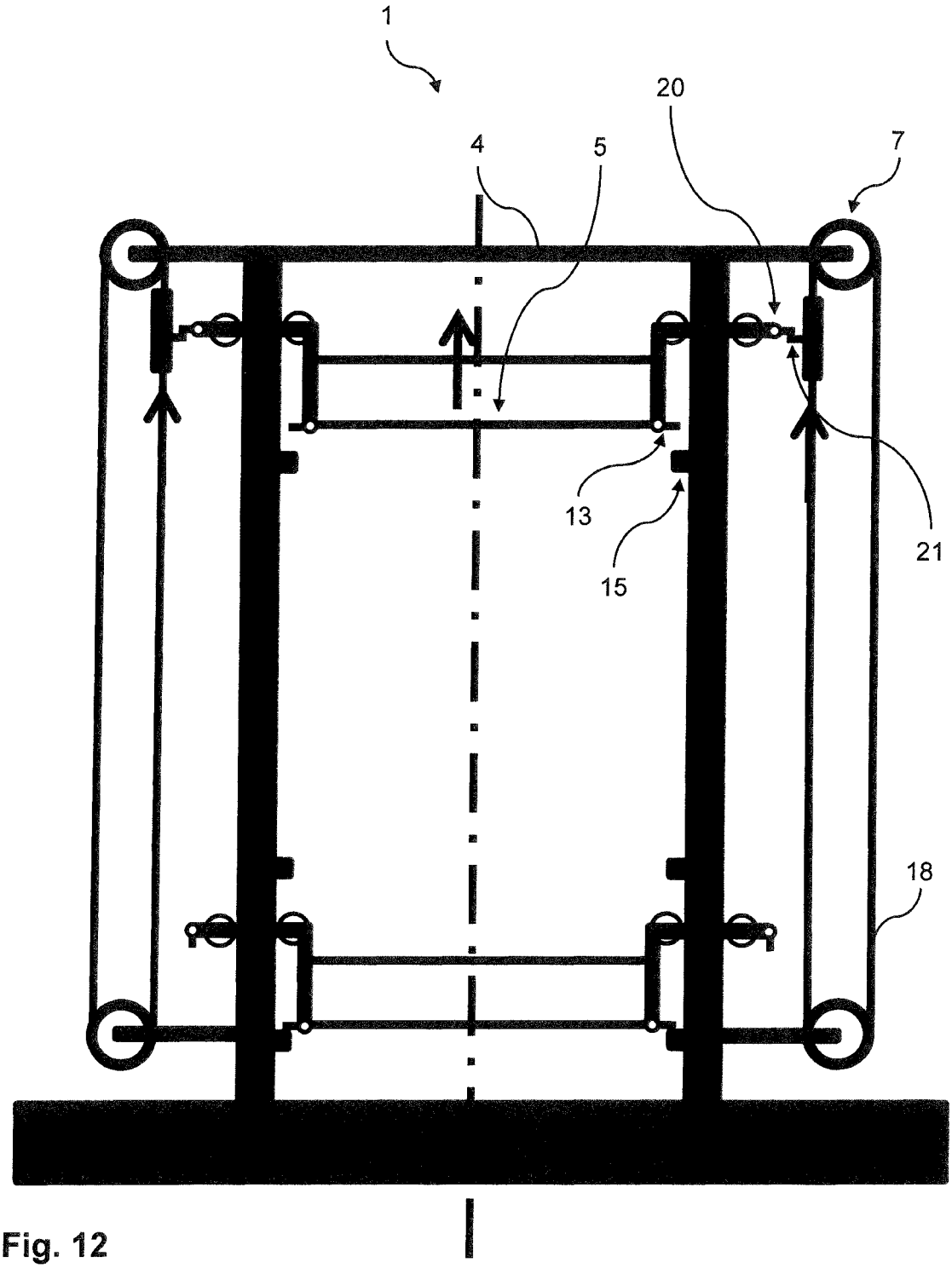
Figure 13:
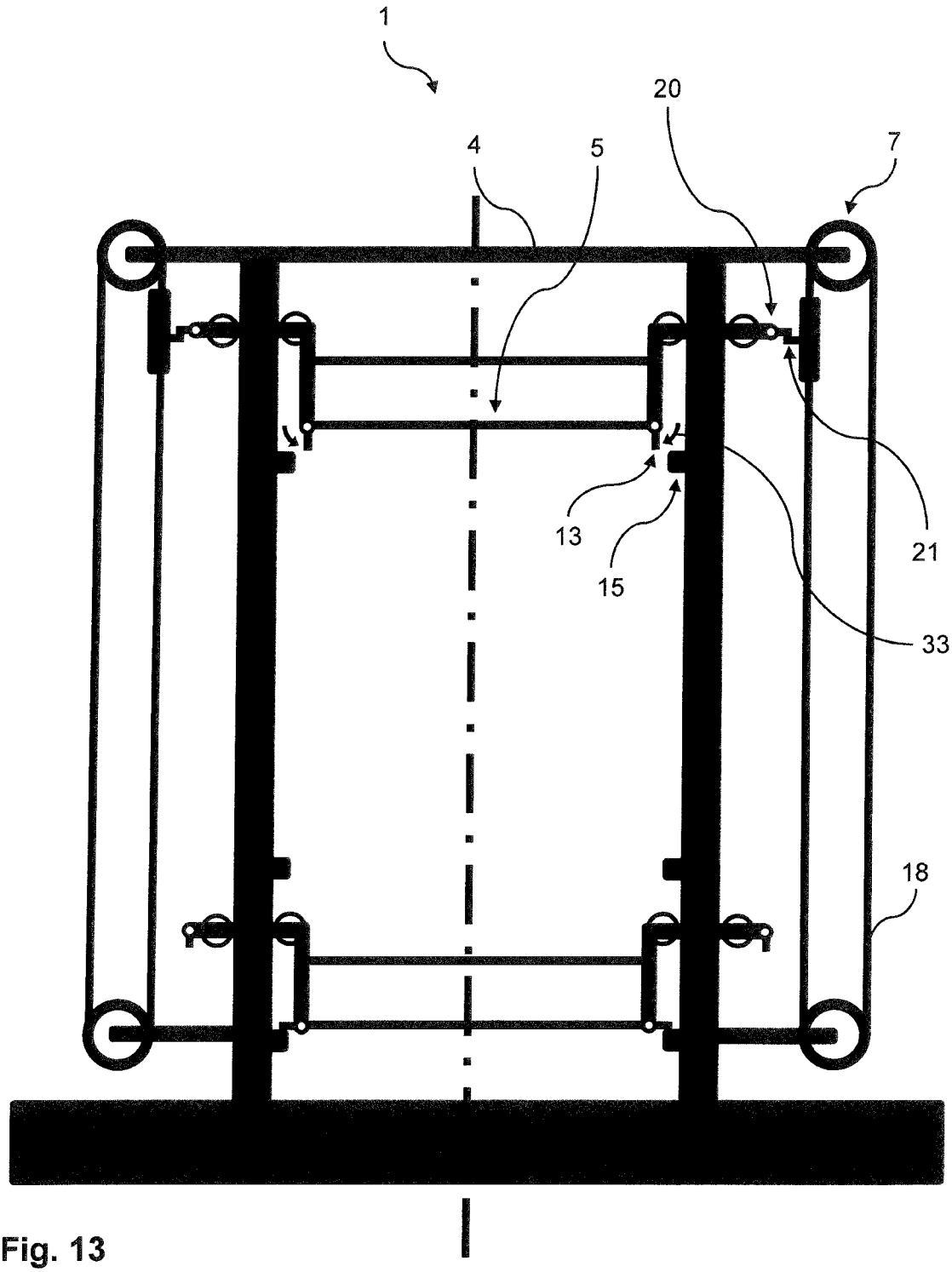
Figure 14:
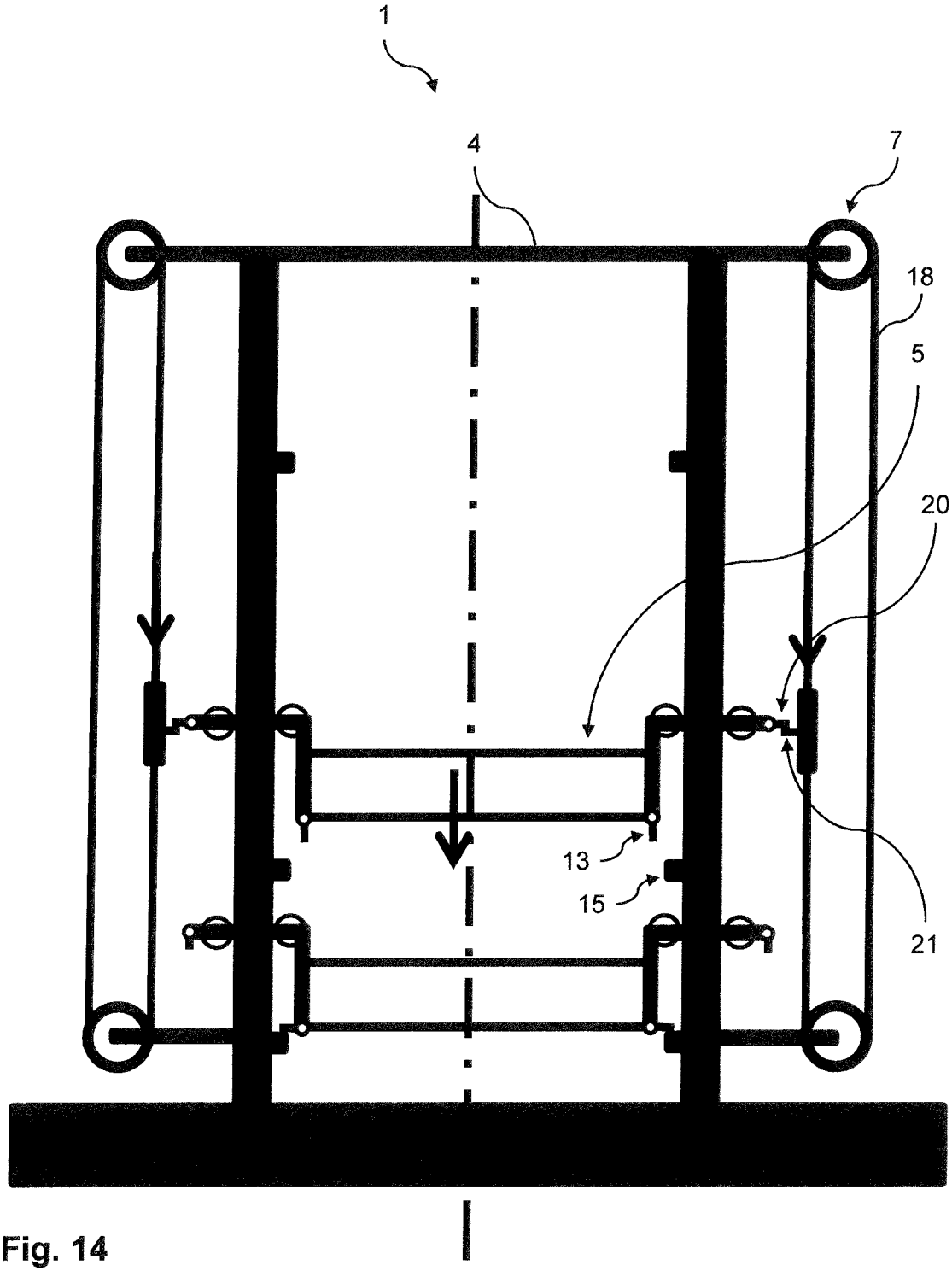

By further movement of the drive 7 upward, the film supply apparatus 5 is raised and, as a result, the positioning coupling devices 13 are relieved of load, as can be seen in FIG. 12. Only when the positioning coupling devices 13 have been relieved of load is it possible for the positioning coupling devices 13 to move from an extended position into a retracted position, as illustrated in FIG. 13 and indicated by the curved arrows 33. By way of the retraction of the positioning coupling devices 13, the possible contact between the positioning coupling devices 13 and the mountings 15 on the machine frame 4 is canceled. It is thus possible to lower the film supply apparatus 5 along the machine frame 4 with the aid of the drive 7. This is illustrated in FIG. 14.

Figure 15:
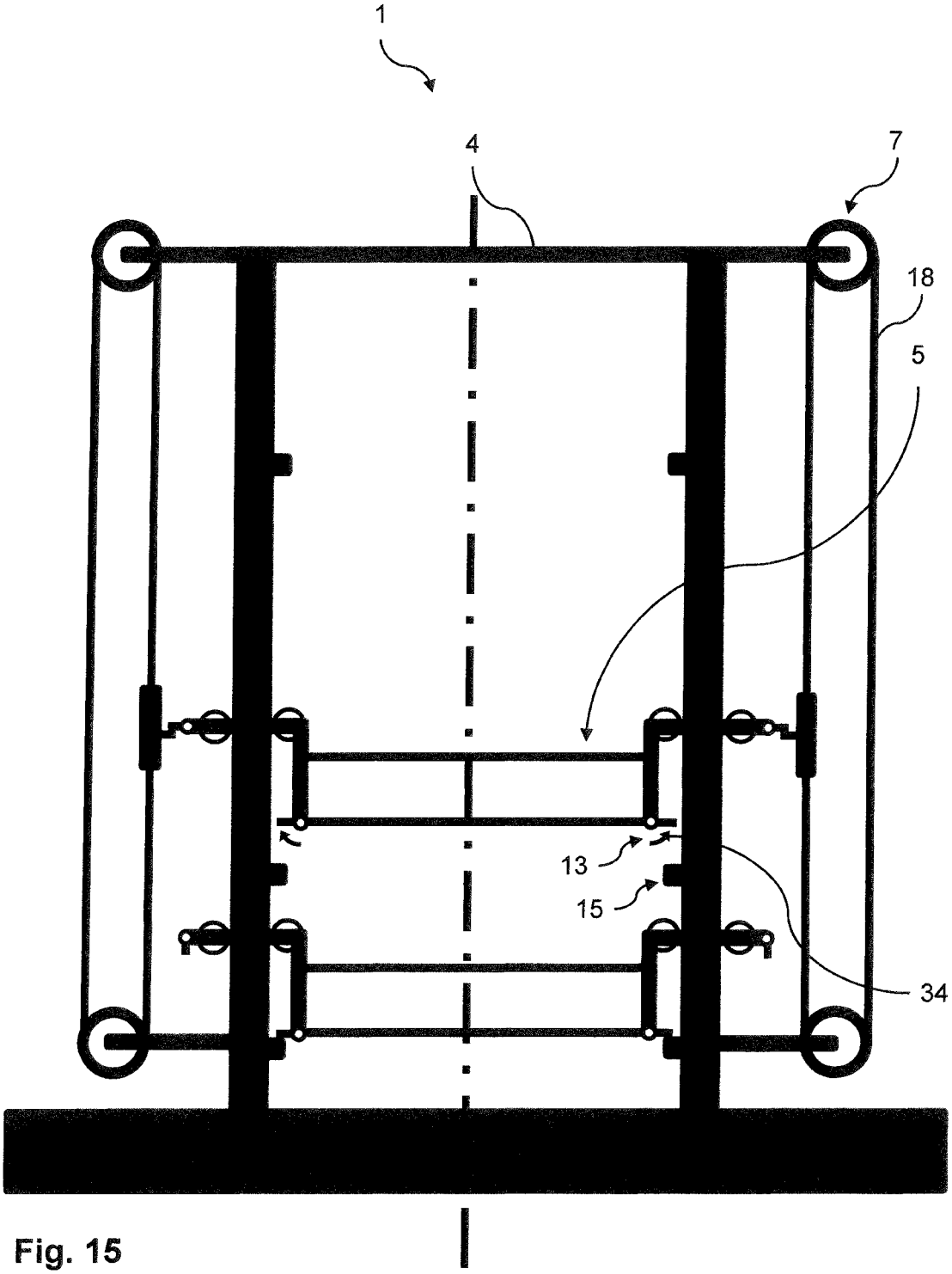
Figure 16:
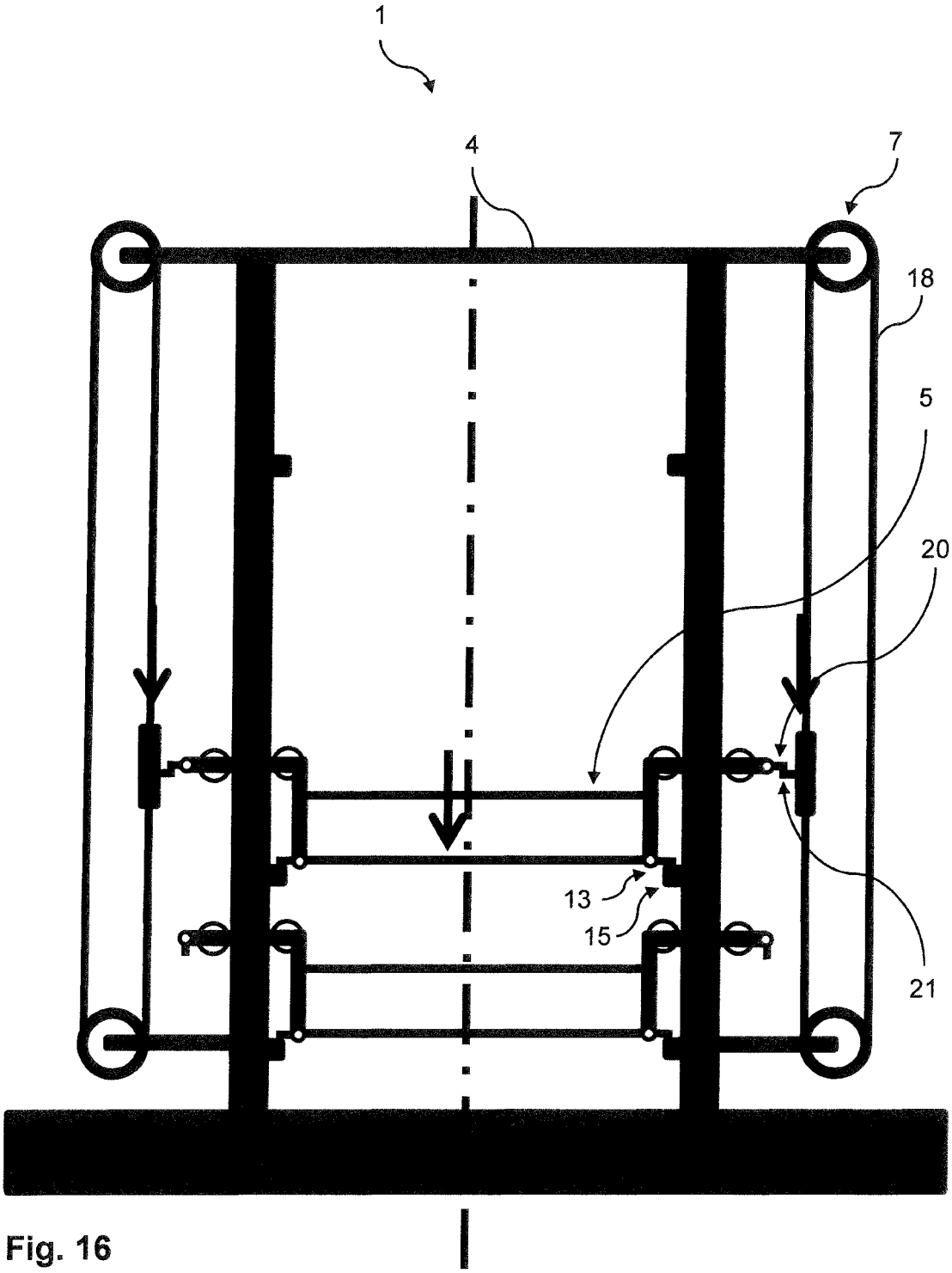
Figure 17:
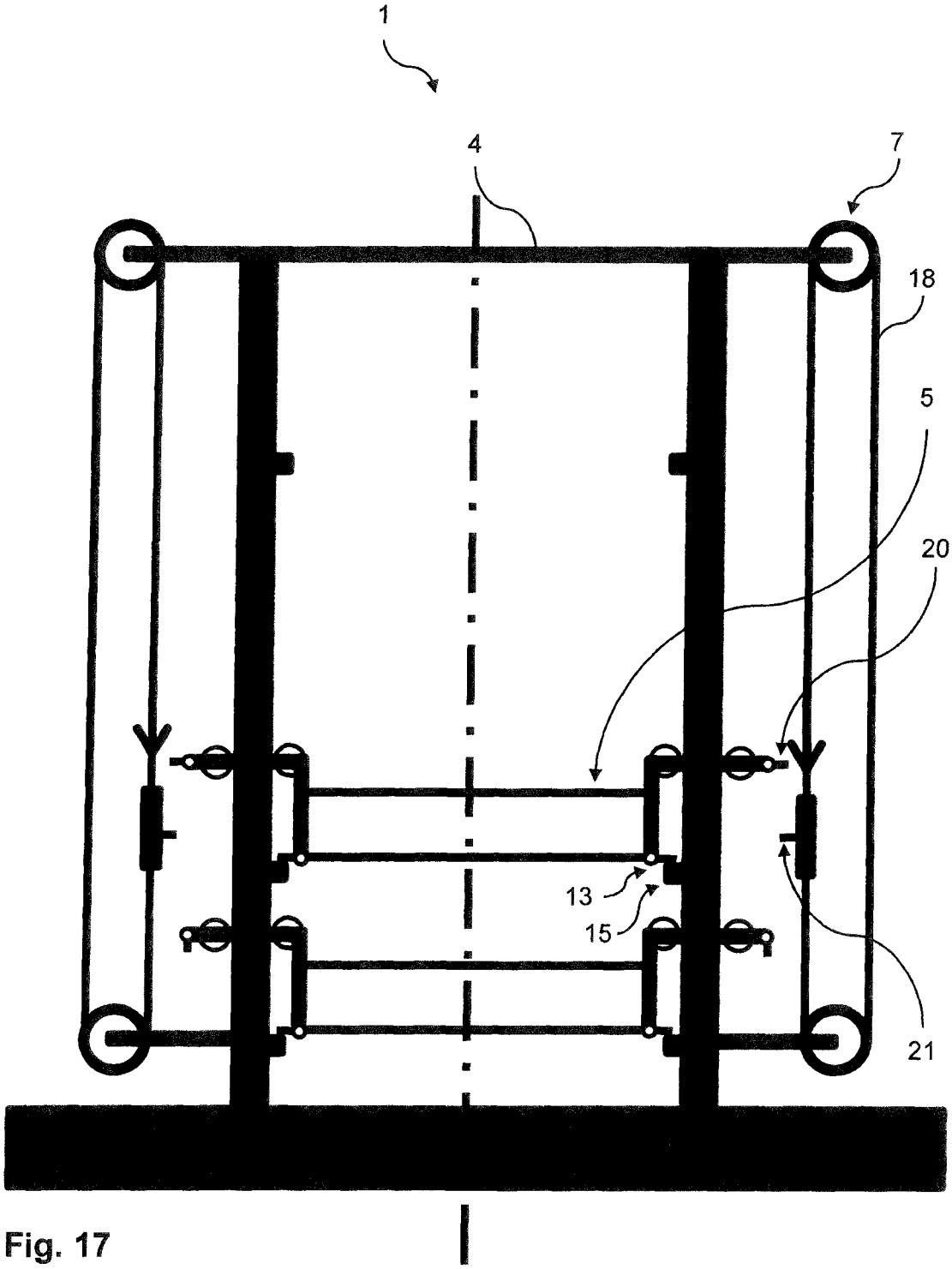

To relieve the drive 7 of load during the maintenance of the film supply apparatus 5, the film supply apparatus 5 is also brought in the maintenance position thereof into operative connection with the machine frame 4 again. This again takes place with the positioning coupling devices 13. For this purpose, the positioning coupling devices 13 are moved, for example by way of pneumatics, into an extended position shortly before the film supply apparatus 5 is moved in the maintenance position thereof. This is illustrated in FIG. 15 and is indicated by the curved arrows 34. In the present case, mountings 15 are in turn mounted on the machine frame 4 level with the machine frame on which the film supply apparatus 5 is intended to be positioned for maintenance. The extended positioning coupling devices 13 ensure that the film supply apparatus 5 can be deposited on the mounting 15, as shown in FIG. 16. As a result, the drive 7 can be relieved of load and the maintenance to the film supply apparatus 5 can be carried out safely. The unloaded state of the drive 7 is illustrated in FIG. 17.

To bring the packaging apparatus 1 from the maintenance position thereof again into an operating position, the sequence described in FIG. 2 to FIG. 17 takes place analogously, but in a reverse sequence.

The described illustrations merely show a schematic and basic illustration of the packaging apparatus of the present disclosure. Many other variants are also conceivable. For example, numerous mountings can be arranged on the machine frame to permit a multiplicity of possible maintenance positions for the film supply apparatus and the film covering apparatus. It is also possible for the film supply apparatus to have a plurality of separately-movable components. Analogous to the exemplary embodiment shown and described above, a first subcomponent of the film supply apparatus could then be moved into a maintenance position and, thereafter and in the same manner, a plurality of other subcomponents could then be moved into a maintenance position in subsequent steps.

Various changes and modifications to the presently preferred embodiments described herein will be apparent to those skilled in the art. These changes and modifications can be made without departing from the spirit and scope of the present subject matter and without diminishing its intended advantages. It is intended that such changes and modifications be covered by the appended claims.

While the features, methods, devices, and systems described herein may be embodied in various forms, there are shown in the drawings, and have been described, some exemplary and non-limiting embodiments. Not all of the depicted components described in this disclosure may be required, however, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. This specification is intended to be taken as a whole and interpreted in accordance with the principles of the invention as taught herein and understood by one of ordinary skill in the art.

| List of reference numbers: | |
|---|---|
| 1. | Packaging apparatus |
| 2. | Article |
| 3. | Film |
| 4. | Machine frame |
| 5. | Film supply apparatus |
| 6. | Film covering apparatus |
| 7. | Drive |
| 8. | Drive coupling |
| 13. | First positioning coupling device |
| 14. | Second positioning coupling device |
| 15. | Mounting |
| 18. | Drive belt/chain/cable/piston |
| 20. | Catch lever |
| 21. | Counterpart |

The invention is claimed as follows:

1. A packaging apparatus for packaging at least one article with a tubular film, the packaging apparatus comprising:

a frame;

a film supply apparatus movable relative to the frame and including a subcomponent comprising a subcomponent catch device, wherein the subcomponent catch device is movable between a first engaged position and a first disengaged position;

a film covering apparatus movable relative to the frame and including a covering-apparatus catch device movable between a second engaged position and a second disengaged position;

a drive element comprising a drive catch device;

a drive operably connected to the drive element to drive the drive element to move the drive catch device relative to the frame; and a controller configured to control the drive, to move the subcomponent catch device between the first engaged and disengaged positions, and to move the covering-apparatus catch device between the second engaged and disengaged positions, wherein the subcomponent catch device is engageable by the drive catch device when in the first engaged position but not when in the first disengaged position, wherein the covering-apparatus catch device is engageable by the drive catch device when in the second engaged position but not when in the second disengaged position.

2. The packaging apparatus of claim 1, wherein only one of the subcomponent catch device and the covering-apparatus catch device is engageable by the drive catch device at a time.

3. The packaging apparatus of claim 1, wherein the controller is configured to, when the subcomponent of the film supply apparatus is in a subcomponent operating position:

move the subcomponent catch device to the first engaged position;

control the drive to drive the drive element to raise the drive catch device into engagement with the subcomponent catch device; and thereafter, control the drive to drive the drive element to move the drive catch device and the subcomponent relative to the frame and the film covering apparatus until the subcomponent reaches a subcomponent maintenance position below the subcomponent operating position.

4. The packaging apparatus of claim 3, wherein the subcomponent further comprises a subcomponent positioning coupling device releasably engageable to the frame, wherein the controller is further configured to, after the drive catch device engages the subcomponent catch device, control the drive to drive the drive element to raise the drive catch device and the subcomponent to enable the positioning coupling device to disengage the frame.

5. The packaging apparatus of claim 4, wherein the subcomponent positioning coupling device comprises a positioning lever movable between a first position in which the positioning lever is positioned to engage the frame and a second position in which the positioning lever is positioned not to engage the frame.

6. The packaging apparatus of claim 5, wherein the controller is further configured to, after raising the drive catch device and the subcomponent, move the positioning lever from the first position to the second position.

7. The packaging apparatus of claim 3, wherein the subcomponent catch device comprises a first lever and a first lever drive operably connected to the first lever to pivot the first lever between the first engaged and disengaged positions, wherein the controller is operably connected to the first lever drive to control the first lever drive to pivot the first lever between the first engaged and disengaged positions.

8. The packaging apparatus of claim 3, wherein the controller is configured to, when the film covering apparatus is in a covering-apparatus operating position:

move the covering-apparatus catch device to the second engaged position;

control the drive to drive the drive element to raise the drive catch device into engagement with the covering-apparatus catch device; and thereafter, control the drive to drive the drive element to move the drive catch device and the film-covering apparatus relative to the frame and the subcomponent of the film supply apparatus until the film-covering apparatus reaches a covering-apparatus maintenance position below the covering-apparatus operating position.

9. The packaging apparatus of claim 8, wherein the controller is configured to move the subcomponent catch device to the first disengaged position before controlling the drive to drive the drive element to raise the drive catch device into engagement with the covering apparatus catch device.

10. The packaging apparatus of claim 8, wherein the covering-apparatus catch device comprises a second lever and a second lever drive operably connected to the second lever to pivot the second lever between the second engaged and disengaged positions, wherein the controller is operably connected to the second lever drive to control the second lever drive to pivot the second lever between the second engaged and disengaged positions.

11. The packaging apparatus of claim 1, wherein the subcomponent of the film supply apparatus comprises at least one of: a film store, a film feed apparatus, a film opening apparatus, a cutting apparatus, and a welding apparatus.

12. The packaging apparatus of claim 11, wherein the drive element comprises at least one of: a drive chain, a drive cable, a linkage, and a drive belt.

* * * * *